US012636552B1

(12) United States Patent
Hobbs et al.

(10) Patent No.: US 12,636,552 B1
(45) Date of Patent: May 26, 2026

(54) GOLF CLUB HEAD

(71) Applicant: Cobra Golf Incorporated, Carlsbad, CA (US)

(72) Inventors: Bryce W. Hobbs, Carlsbad, CA (US); Ryan L. Roach, Encinitas, CA (US)

(73) Assignee: Cobra Golf Incorporated, Carlsbad, CA (US)

( * ) Notice: Subject to any disclaimer, the term of this patent is extended or adjusted under 35 U.S.C. 154(b) by 165 days.

(21) Appl. No.: 17/752,981

(22) Filed: May 25, 2022

(51) Int. Cl.
*A63B 23/04* (2006.01)
*A63B 53/04* (2015.01)
*A63B 60/54* (2015.01)

(52) U.S. Cl.
CPC ..... *A63B 53/0416* (2020.08); *A63B 53/0433* (2020.08); *A63B 53/047* (2013.01); *A63B 60/54* (2015.10); *A63B 2209/00* (2013.01)

(58) Field of Classification Search
CPC ..... A63B 53/0416; A63B 53/0433; A63B 53/047; A63B 60/54; A63B 2209/00
See application file for complete search history.

(56) References Cited

U.S. PATENT DOCUMENTS 1,768,792 A * 7/1930 Schavoir ..... A63B 53/04 473/329
6,030,293 A * 2/2000 Takeda ..... A63B 53/04 473/345
6,030,295 A * 2/2000 Takeda ..... A63B 60/00 473/335
6,533,679 B1 * 3/2003 McCabe ..... A63B 60/02 473/335
7,022,029 B2 * 4/2006 Caldwell ..... A63B 53/0466 473/409
7,303,486 B2 * 12/2007 Imamoto ..... A63B 53/047 473/332
7,316,623 B2 * 1/2008 Imamoto ..... A63B 53/047 473/332
7,476,162 B2 * 1/2009 Stites ..... A63B 60/00 473/332
7,481,719 B2 * 1/2009 Imamoto ..... A63B 53/047 473/332
8,088,025 B2 * 1/2012 Wahl ..... A63B 60/00 473/345
8,936,518 B2 * 1/2015 Takechi ..... A63B 53/047 473/335
9,808,685 B1 * 11/2017 Westrum ..... A63B 53/047
10,039,965 B1 * 8/2018 Seluga ..... A63B 60/54
10,052,535 B1 * 8/2018 Westrum ..... A63B 60/00
10,173,108 B2 * 1/2019 Westrum ..... A63B 53/047
10,220,272 B2 * 3/2019 Gonzalez ..... A63B 53/0475
10,493,336 B2 * 12/2019 Taylor ..... A63B 53/02
10,744,379 B2 * 8/2020 Westrum ..... A63B 60/00
10,905,920 B2 * 2/2021 Parsons ..... A63B 60/02
11,192,003 B2 * 12/2021 Parsons ..... A63B 53/04
(Continued)

*Primary Examiner* — William M Pierce
(74) *Attorney, Agent, or Firm* — Quarles & Brady LLP

(57) ABSTRACT

A golf club head includes a body including a toe region, a heel region, and a medial region extending between the toe region and the heel region. A core bar is integrally formed with the body at the toe region and the heel region and extends within the medial region along a trailing end. Further, a slot has an upper edge formed along a lower edge of the core bar at the trailing end. A face insert is coupled to the body and an interior cavity is formed between the face insert and the core bar.

17 Claims, 17 Drawing Sheets

(56) References Cited

U.S. PATENT DOCUMENTS

| | | | | |
|---|---|---|---|---|
| 11,369,847 | B2 * | 6/2022 | Parsons | A63B 53/04 |
| 11,559,727 | B2 * | 1/2023 | Demkowski | A63B 60/50 |
| 11,565,158 | B1 * | 1/2023 | Parsons | A63B 60/02 |
| 11,707,653 | B2 * | 7/2023 | Parsons | A63B 53/00 29/592 |
| 11,707,655 | B2 * | 7/2023 | Parsons | A63B 60/02 473/345 |
| 11,786,786 | B2 * | 10/2023 | Parsons | A63B 60/50 29/592 |
| 11,826,620 | B2 * | 11/2023 | Ines | A63B 60/54 |
| 11,839,799 | B2 * | 12/2023 | Kroloff | A63B 53/0466 |
| 11,865,417 | B2 * | 1/2024 | Parsons | A63B 53/04 |
| 12,161,923 | B2 * | 12/2024 | Spackman | A63B 53/0475 |
| 12,515,112 | B2 * | 1/2026 | Kaplan | A63B 53/0475 |
| 2004/0043830 | A1 * | 3/2004 | Imamoto | A63B 53/047 473/332 |
| 2013/0281227 | A1 * | 10/2013 | Roach | A63B 69/0002 473/332 |
| 2018/0221726 | A1 * | 8/2018 | Westrum | A63B 60/00 |
| 2019/0247726 | A1 * | 8/2019 | Parsons | A63B 53/047 |

* cited by examiner

GOLF CLUB HEAD

CROSS REFERENCE TO RELATED APPLICATIONS

Not applicable

REFERENCE REGARDING FEDERALLY SPONSORED RESEARCH OR DEVELOPMENT

Not applicable

SEQUENCE LISTING

Not applicable

BACKGROUND

1. Field of the Disclosure

The present disclosure relates to golf clubs, and more specifically to a golf club head that includes a face insert.

2. Description of the Background

Different types of golf clubs are used to effect different types of shots, based on a golfer's location and ball lie when playing a hole on a golf course. An iron is a golf club that is used to make a variety of shots on a golf hole, for example, approach shots, bunker shots, chips, etc. Conventional iron-type golf club heads may include a face insert that is attached to a body. For example, a conventional face insert may be in the form of 2-D plate that is welded around the periphery of the insert to adjoin to the body.

Many golfers at all skill levels constantly seek to improve their performance and lower their golf scores. As a result, players are frequently seeking updated and improved equipment. The performance of a golf club can vary based on several factors, including face insert design.

Generally, golf ball travel distance is a function of the total kinetic energy imparted to the ball during impact with the club head, neglecting environmental effects. During impact, kinetic energy is transferred from the club so that it is stored as elastic strain energy in the club head and as viscoelastic strain energy in the ball. After impact, the stored energy in the ball and in the club is transformed back into kinetic energy in the form of translational and rotational velocity of the ball, as well as the club. Since the collision is not perfectly elastic, a portion of energy is dissipated in club head vibration and viscoelastic relaxation of the ball, which is a material property of the polymeric materials used in all manufactured golf balls.

Viscoelastic relaxation of the ball is a parasitic energy source, which is dependent upon the rate of deformation. To decrease or minimize this effect, the rate of deformation must be reduced, which may be accomplished by allowing more face insert deformation during impact. Since metallic deformation may be purely elastic, the strain energy stored in the face insert is returned to the ball after impact, which may increase the ball's outbound velocity after impact. A variety of techniques may be used to vary the allowable deformation of the face insert, including uniform face thinning, thinned faces with ribbed stiffeners and varying thickness, among others.

In general, conventional golf club heads may include a face insert that is coupled (e.g., welded) to a body. The body typically makes up the majority of the golf club head's total mass, and the mass of the body is positioned toward the sole and the trailing edge (e.g., an edge of a golf club head that is arranged at the intersection between the sole and the rear or back face of the golf club head) of the body to promote higher launch angle and lower center of gravity. The arrangement of the mass in the body increases a thickness and a stiffness in these portions of the body, which reduces flexibility and accordingly diminishes forgiveness and distance provided by the golf club head.

In some conventional golf club heads, a higher density material such as tungsten is welded to the body of the golf club head to add weight in particular regions of the body. But, like thicker, high mass portions of the body in conventional golf club heads, tungsten stiffens the body and limits the flexibility of the entire body structure. Further, attaching weight to the sole, trailing edge (e.g., an edge of a golf club head that is arranged at the intersection between the sole and the rear or back face of the golf club head), or back cavity of the body make the body stiff and limits flexibility.

SUMMARY

In some aspects, a golf club head includes a body including a toe region, a heel region, and a medial region extending between the toe region and the heel region. A core bar is integrally formed with the body at the toe region and the heel region and extends within the medial region along a trailing end. Further, a slot has an upper edge formed along a lower edge of the core bar at the trailing end. A face insert is coupled to the body and an interior cavity is formed between the face insert and the core bar.

In some embodiments, the golf club head further includes a filler material at least partially surrounding the core bar. The filler material is disposed within the interior cavity. In some embodiments, the filler material is a polymer. In some embodiments, the core bar is suspended above a sole surface of the body. In some embodiments, the slot formed at least in part by the core bar is filled with a slot filler material. In some embodiments, a lower edge of the slot is formed by a portion of the face insert that is spaced apart from the core bar. In some embodiments, the a lower edge of the slot is formed by a portion of the body that is spaced apart from the core bar.

In some aspects, a golf club head includes a body including a core bar integrally formed with the body at a toe region and a heel region and disposed within a medial region of the body. The body defines a leading end and a trailing end. Further, a face insert is coupled to the body and includes a sole return that extends from a lower end of a face surface rearward to a trailing edge that contacts the trailing end of the body. An interior cavity is formed between the sole return and the core bar of the body. Additionally, a filler material is arranged within the interior cavity.

In some embodiments, the interior cavity has a first gap distance and a second gap distance, the first gap distance being different from the second gap distance. In some embodiments, the trailing edge of the sole return is disposed adjacent to a slot formed at the trailing end of the body. In some embodiments, the sole return has a thickness that varies between the trailing edge and a leading edge. In some embodiments, the sole return and the face insert comprise a unitary component. In some embodiments, the filler material is a polymer. In some embodiments, the face insert is coupled to the body along a receiving edge that at least partially surrounds the core bar.

In some aspects, a method of manufacturing a golf club head includes forming a body and a face insert separately from one another, the body including a core bar and a slot that is disposed at a trailing end of the body and formed along the core bar. The method further includes joining the face insert to the body to form an interior cavity, such that the face insert is distanced from the core bar. Further, the method includes filling the slot with a first material and filling the interior cavity with a second material.

In some embodiments, the slot is in fluid communication with the interior cavity. In some embodiments, the first material has a first hardness and the second material has a second hardness, the first hardness being greater than the second hardness. In some embodiments, the face insert includes a sole return having a trailing edge that at least partially defines the slot. In some embodiments, the body includes a receiving edge that surrounds the core bar and the face insert is joined to the receiving edge. In some embodiments, the slot spans between the core bar and a sole member that is spaced apart from the core bar.

DETAILED DESCRIPTION OF THE DRAWINGS

Figure 1:
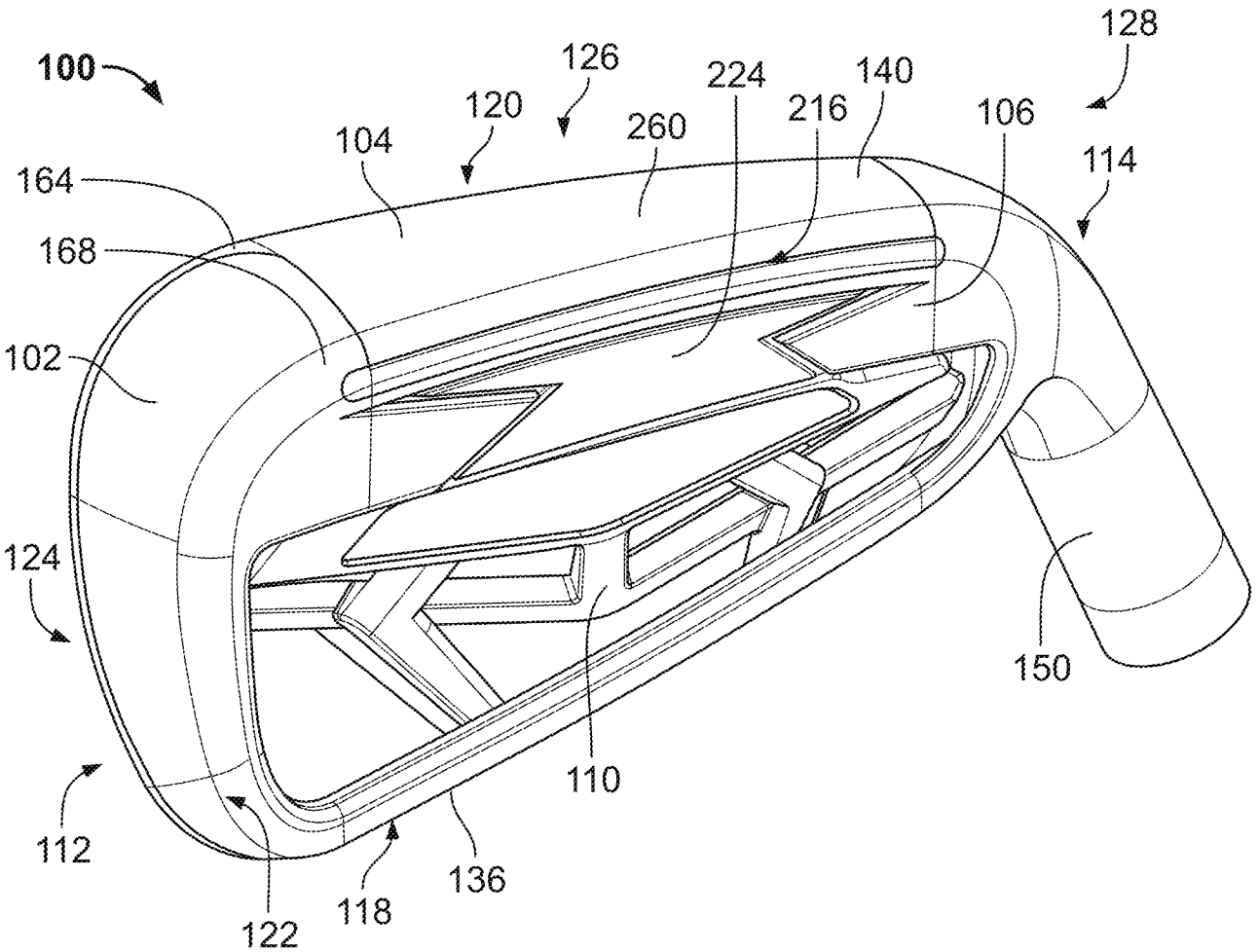
FIG. 1 is a rear, bottom, and left isometric view of a golf club head, according to an embodiment of the present disclosure.

The following discussion and accompanying figures disclose various embodiments or configurations of a golf club that includes a shaft and a golf club head. Although embodiments are disclosed with reference to a iron-type golf club, concepts associated with embodiments of the iron-type golf club may be applied to a wide range of golf clubs. For example, embodiments disclosed herein may be applied to a number of golf clubs including driver-type clubs, hybrid clubs, fairway wood clubs, putter-type clubs, utility-type golf clubs, and the like. The term "about," as used herein, refers to variation in the numerical quantity that may occur, for example, through typical measuring and manufacturing procedures used for articles of manufacture that may include embodiments of the disclosure herein. Throughout the disclosure, the terms "about" and "approximately" refer to a range of values ±5% of the numeric value that the term precedes. Additionally, the term "horizontal" should be understood to refer to a general heel-to-toe direction and the term "vertical" should be understood to refer to a general crown-to-sole direction, allowing for curvature, and not being construed so as to be limited to strict linear dimensions between those respective endpoints. As used herein, the terms "mass" and "weight" are used interchangeably, although it is understood that these terms refer to different properties in a strict physical sense.

To overcome the reduced flexibility in conventional golf club heads, the present disclosure provides an iron-type golf club head with a face insert having a sole return extending toward the trailing edge of the body. Further, the face insert is spaced apart or distanced from direct contact with a core bar disposed near the sole of the body. In some embodiments, the sole return extends to a trailing end slot of the body, which allows the sole return portion to be distanced from the body at the trailing end. In some embodiments, the sole return abuts a sole member on the trailing end of the body, and a slot is disposed between the sole member and a core bar of the body, which allows the sole member and the sole return to be distanced from the core bar. Accordingly, by distancing portions of the face insert from portions of the body, the face insert experiences greater flexure during impact with a golf ball, which may result in greater kinetic energy return to the golf ball and, thus, greater golf ball velocity after impact.

In some embodiments, the filler material may be injected or poured into an inner cavity of the body after the face insert is attached to the body. The filler material at least partially fills the gaps formed between the core bar and the face insert. In this way, for example, the filler material is configured to prevent direct contact between the core bar and the face insert (e.g., during and after impact). In addition, the filler material may improve vibration performance of the body and may improve the sound generated at impact.

Figure 2:
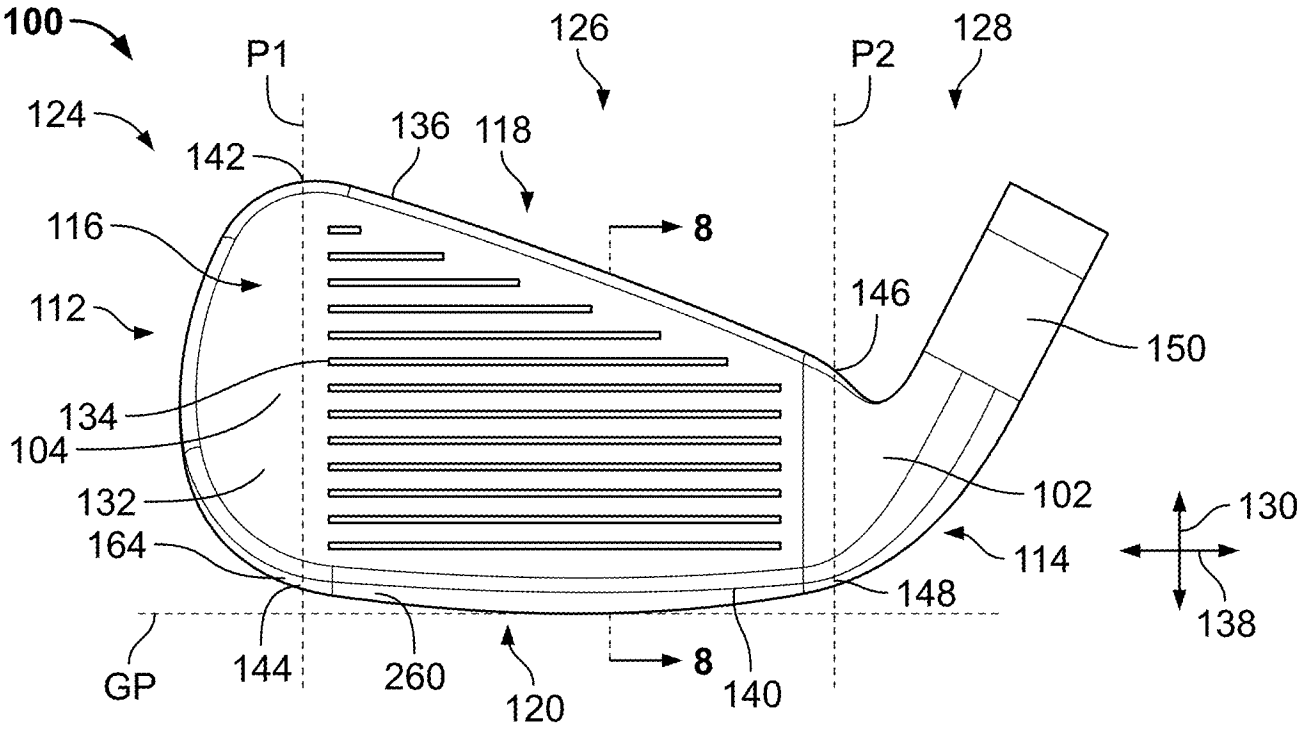
FIG. 2 is a front elevational view of the club head of FIG. 1.

Referring now to FIGS. 1 and 2, a golf club head 100, for example, an iron-type golf club head, is shown in accordance with an embodiment of the present disclosure. The iron-type golf club head 100 includes a body 102 and a face insert 104, which may be coupled to one another after machining of the body 102. In some embodiments, the face insert 104 may be manufactured from a different material than the body 102. For example, the body 102 and the face insert 104 may be manufactured from different metal or non-metallic materials (e.g., different types of stainless steel, polymer, or carbon composite). The body 102 includes a body weight bar or core bar 106 that may be fabricated from the same type of material (e.g., the same type of stainless steel) as the rest of the body 102. In some embodiments, the core bar 106 may be fabricated from a material with a higher density than the rest of the body 102 (e.g., a tungsten core and a stainless steel body). In some embodiments, the core bar 106 may be fabricated from a material with a lower density than the rest of the body 102. When the iron-type golf club head 100 is assembled, the core bar 106 is partially surrounded by a filler material 108 (see FIG. 5) and a medallion 110 is attached to a side of the body 102 that is opposite to the face insert 104 (e.g., on a rear side of the body 102).

The iron-type golf club head 100 defines a toe side 112, a heel side 114, a front side 116 (see FIG. 2), a top side 118, a bottom side 120, and a rear side 122 (see FIG. 1). The iron-type golf club head 100 further includes a toe region 124, a medial region 126, and a heel region 128. Referring specifically to FIG. 2, the toe region 124, the medial region 126, and the heel region 128 may be defined by lines or planes P1 and P2 that extend through the iron-type golf club head 100 in a vertical or sole-topline direction 130, as indicated by the directional coordinate in FIG. 2. The toe region 124 and the heel region 128 are arranged at laterally-opposing ends of the body 102, and the medial region 126 is arranged laterally between the toe region 124 and the heel region 128.

The face insert 104 is attached to the front side 116 of the body 102, the face insert 104 defining a face surface or front face 132 that extends from the toe region 124, through the medial region 126, and at least to a junction between the heel region 128 and the medial region 126. The front face 132 includes a plurality of laterally-extending grooves 134 that are spaced from one another in the sole-topline direction 130. In some embodiments, the front face 132 may define a striking face that makes contact with a golf ball.

The iron-type golf club head 100 defines a topline 136 extending in an inclined lateral or heel-toe direction 138 along the top side 118, and a sole 140 extending laterally in the heel-toe direction 138 along the bottom side 120. In some embodiments, the heel-toe direction 138 may be parallel to a ground plane GP that is defined as a plane that is parallel to the ground on which the iron-type golf club head 100 sits at address. The topline 136 may be formed by the top side 118 of the body 102, the face insert 104, or a combination of the body 102 and the face insert 104. Similarly, the sole 140 may be formed by the bottom side 120 of the body 102, the face insert 104, or a combination of the body 102 and the face insert 104.

In some embodiments, the plane P1 may be defined along or proximate a lateral edge of the grooves 134 formed in the front face 132 that is adjacent to the toe side 112. In the illustrated embodiment, the plane P1 may intersect the top side 118 of the body 102 or the face insert 104 at a toe-topline intersection point 142 along the topline 136 where the slope of a line tangent to the topline 136 is approximately zero (e.g., a point where a line tangent to the periphery of the top side 118 is approximately parallel to the ground at address). In this embodiment, the plane P1 may extend through the iron-type golf club head 100 in the sole-topline direction 130 to a toe-sole intersection point 144 along the bottom side 120.

In some embodiments, the plane P2 may be defined along or proximate a lateral edge of the grooves 134 formed in the front face 132 that is adjacent to the heel side 114. In some embodiments, the plane P2 may be defined by the intersection between a lateral edge of the face insert 104 adjacent to the heel side 114 and the body 102. In the illustrated embodiment, the plane P2 may intersect the top side 118 of the body 102 or the face insert 104 at a heel-topline inflection point 146 (e.g., a point where the periphery of the top side 118 transitions from concave down to concave up). In this embodiment, the plane P2 may extend through the iron-type golf club head in the sole-topline direction 130 to a heel-sole inflection point 148 along the bottom side 120.

The topline 136 may extend along the top side 118 from the toe-topline intersection point 142, along the medial region 126, to the heel-topline inflection point 146. The sole 140 may extend along the bottom side 120 from the toe-sole intersection point 144, along the medial region 126, to the heel-sole inflection point 148. In some embodiments, the topline 136 and the sole 140 may extend farther into the toe region 124 or the heel region 128, or both.

Figure 3:
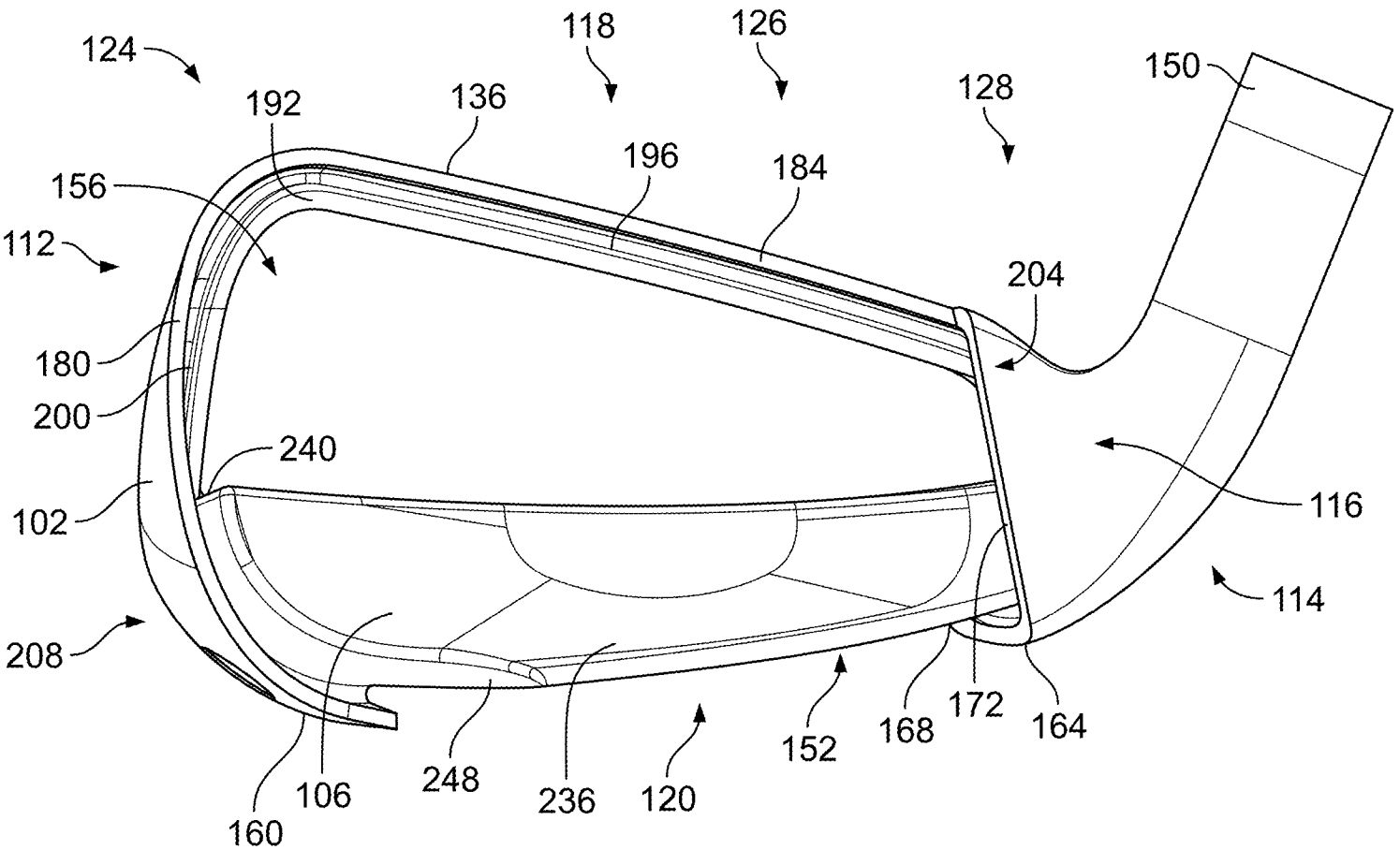
FIG. 3 is a front elevational view of a body of the club head of FIG. 1.

Turning to FIG. 3, the body 102 may be formed as a unitary component (e.g., from a single piece of material). In some embodiments, the body 102 may be formed by a casting process, a forging process, or an additive manufacturing process (e.g., 3-D printing, such as DMLS). Accordingly, the body 102 may be made of a metal or metal alloy, such as, e.g., Grade 431 Stainless Steel. It is contemplated that the body 102 may be formed from a material having a hardness, as measured in accordance with suitable Rockwell Scale C, of between about 15 HRC and about 25 HRC, or between about 17 HRC and about 23 HRC, or between about 19 HRC and about 21 HRC. In some embodiments, the body 102 has a hardness of about 20 HRC. In some embodiments, the body 102 may undergo heat treatment, such that the hardness of the material of the body 102 increases or decreases during forming. The body 102 includes the core bar 106, a hosel 150, a sole cutout 152, and a body cutout 156 that extends through the body 102. The hosel 150 is arranged within the heel region 128 of the body 102 and extends from the heel region 128 at an angle (e.g., a lie angle formed between a plane parallel to the ground on which the club head rests at address and a center axis defined through the hosel 150) in a direction away from the toe region 124.

In general, the sole cutout 152 is formed on the bottom side 120 of the body 102 and extends between the heel region 128 and the toe region 124. Accordingly, the sole cutout 152 extends along the medial region of the body 102. In particular, the sole cutout 152 is formed in a sole surface 160 of the body 102 and extends in a front-rear direction between a leading end 164 and a trailing end 168 of body 102. In the illustrated embodiment, the leading end 164 is arranged on the front side 116 of the body 102 and is configured to be coextensive with the front face 132 of the face insert 104 (see FIG. 2). Further, the trailing end 168 is arranged on the rear side 122 of the body 102.

Additionally, the body 102 is configured to receive the face insert 104 to form the iron-type golf club head 100. Accordingly, the body 102 includes a heel receiving edge 172 that extends generally vertically downward (e.g., in the sole-topline direction 130) from the topline 136 to the sole surface 160 before curving rearwardly (e.g., toward the rear side 122) and extending generally linearly from the leading end 164 to the trailing end 168 on the bottom side 120 of the body 102. A toe receiving edge 180 extends in a generally arcuate path vertically downward from the topline 136 to the sole surface 160 within the toe region 124 before sharply turning rearward and extending linearly generally linearly from the leading end 164 to the trailing end 168 on the bottom side 120 of the body 102. Further, the body 102 includes a top receiving edge 184 along the topline 136. The top receiving edge 184 extends generally laterally (e.g., in the heel-toe direction) from the heel receiving edge 172 to the toe receiving edge 180 on the top side 118 of the body 102. In the illustrated embodiment, the top receiving edge 184 is angled and slopes downwardly from the toe receiving edge 180 to the heel receiving edge 172.

As illustrated in FIG. 3, the top receiving edge 184, the heel receiving edge 172, and the toe receiving edge 180 are provided at or near a periphery of the body 102. Accordingly, the top receiving edge 184, the heel receiving edge 172, and the toe receiving edge 180 at least partially surround the core bar 106 of the body 102. The top receiving edge 184, the heel receiving edge 172, and the toe receiving edge 180 form an interface that is configured to receive the face insert 104 when coupled or joined together. In some embodiments, the face insert 104 contacts only the top receiving edge 184, the heel receiving edge 172, and the toe receiving edge 180 of the body 102, such that contact between the face insert 104 and the body 102 is limited to that interface and, thus, the face insert 104 can be joined to the body 102 in a configuration allowing for improved flexibility. In some embodiments, the face insert 104 and the body 102 are coupled or joined by welding techniques, such as, e.g., by tack welding or laser welding, grinding, and polishing. In some embodiments, the face insert 104 is fastened to the body 102 by suitable fasteners, such as, e.g., by screws, rods, rivets, or the like. In some embodiments, the face insert 104 and the body 102 are integrally formed as a unitary component, such as, e.g., by casting, molding, additive manufacturing, or any other suitable method.

In the illustrated embodiments, the sole surface 160 of the body 102 curves between the leading end 164 and the trailing end 168 within the heel region 128 and the toe region 124. Further, body 102 at least partially defines the sole cutout 152 between opposing portions of the heel receiving edge 172 and the toe receiving edge 180 on the bottom side 120 of the body 102. In some embodiments, the sole cutout 152 extends continuously from the leading end 164 to the trailing end 168 of the body 102. In some embodiments, the sole cutout 152 extends continuously along the medial region 126 between the heel region 128 and the toe region 124.

The body 102 includes a rear flange 192 arranged on the rear side 122. The rear flange 192 extends from the heel region 128 to the toe region 124 of the body 102. Further, the rear flange 192 extends along the medial region 126 of the body 102 proximate to or along the topline 136 on the top side 118. In the illustrated embodiment, the rear flange 192 extends laterally along the topline 136, sloping upwardly from the heel region 128 to the toe region 124 before curving downwardly within the toe region 124 and extending generally vertically toward the bottom side 120 of the body 102. A top inner surface 196 is at least partially formed on the rear flange 192 within the medial region 126 of the body 102. In the illustrated embodiment, the top inner surface 196 is arranged at or near the topline 136 and extends between the rear flange 192 and the top receiving edge 184. Further, a toe inner surface 200 is at least partially formed on the rear flange 192 within the toe region 124 of the body 102. In the illustrated embodiment, the toe inner surface 200 is arranged within the toe region 124 and extends between the rear flange 192 and the toe receiving edge 180.

Figure 5:
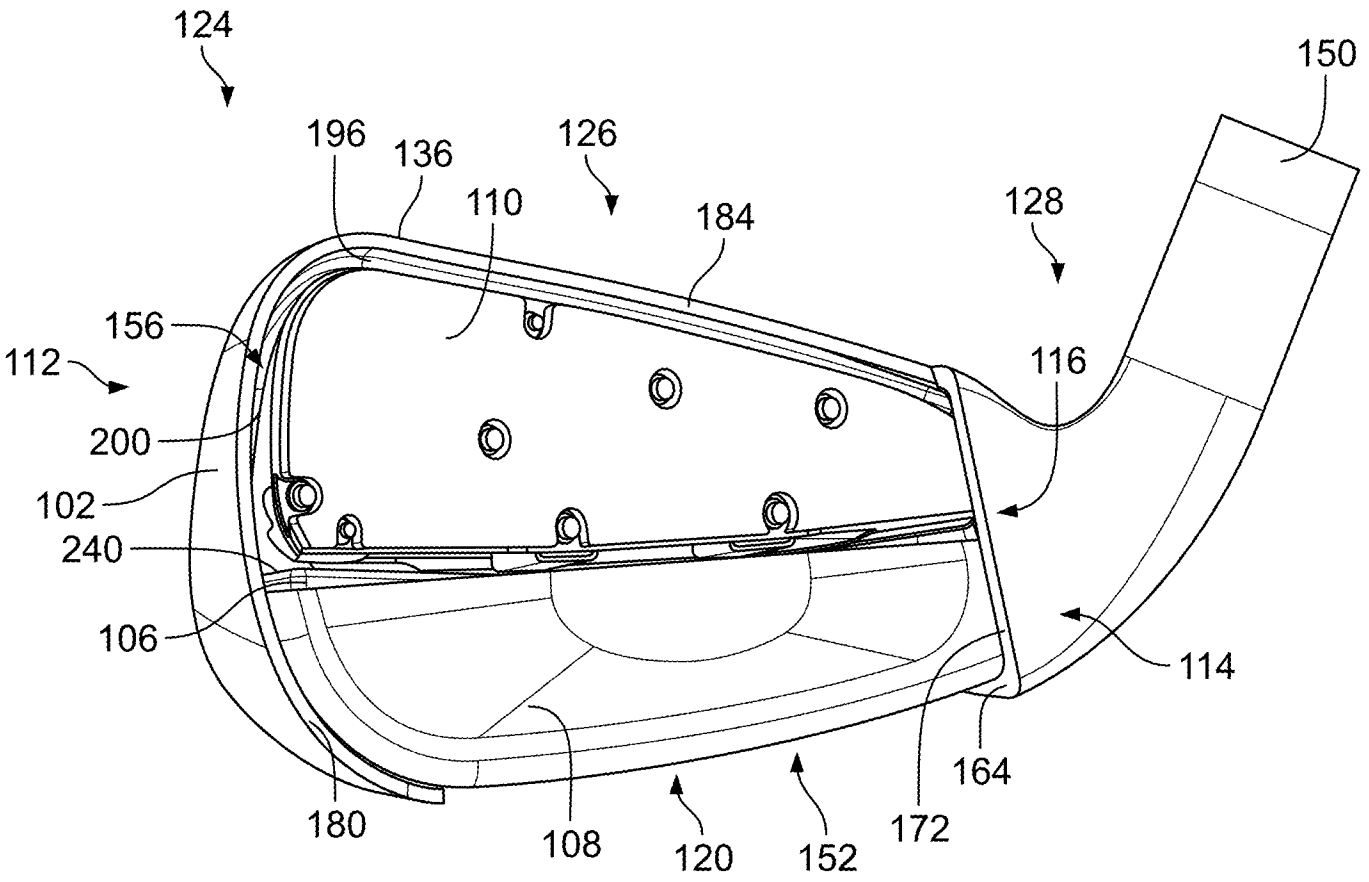
FIG. 5 is a front and left isometric view of the club head of FIG. 1 with a face insert hidden from view.

The body cutout 156 is at least partially defined by the rear flange 192. The body cutout 156 is arranged on the rear side 122 of the body 102 and extends from the heel region 128 to the toe region 124 of the body 102. In the illustrated embodiment, the body cutout 156 extends continuously laterally along the medial region 126 of the body 102 and vertically from the topline 136 to the core bar 106. That is, the body cutout 156 is disposed vertically above the core bar 106, such that an upper segment 204 of the body 102 includes the topline 136 and the body cutout 156 and a lower segment 208 of the body 102 comprises the core bar 106 and the sole cutout 152. With reference to FIGS. 1, 3, and 5, the medallion 110 is at least partially received within the body cutout 156 and is configured to be exposed through the body cutout 156 on the rear side 122 of the body 102. It is contemplated that the lower segment 208 of the body 102 comprises greater than 50% of a total mass of the body 102.

Figure 4:
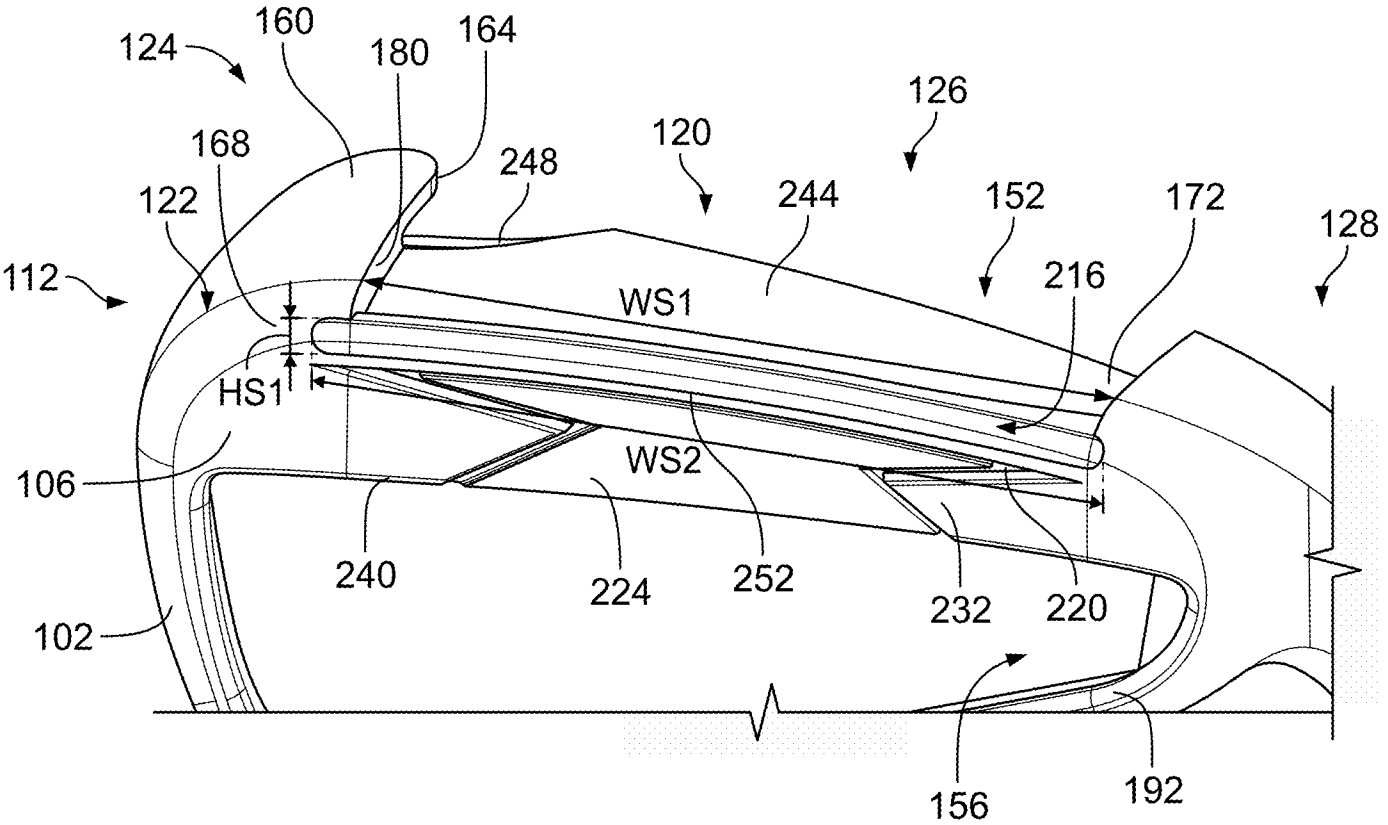
FIG. 4 is a rear, bottom, and right isometric view of a portion of the body of FIG. 3.
Figure 8:
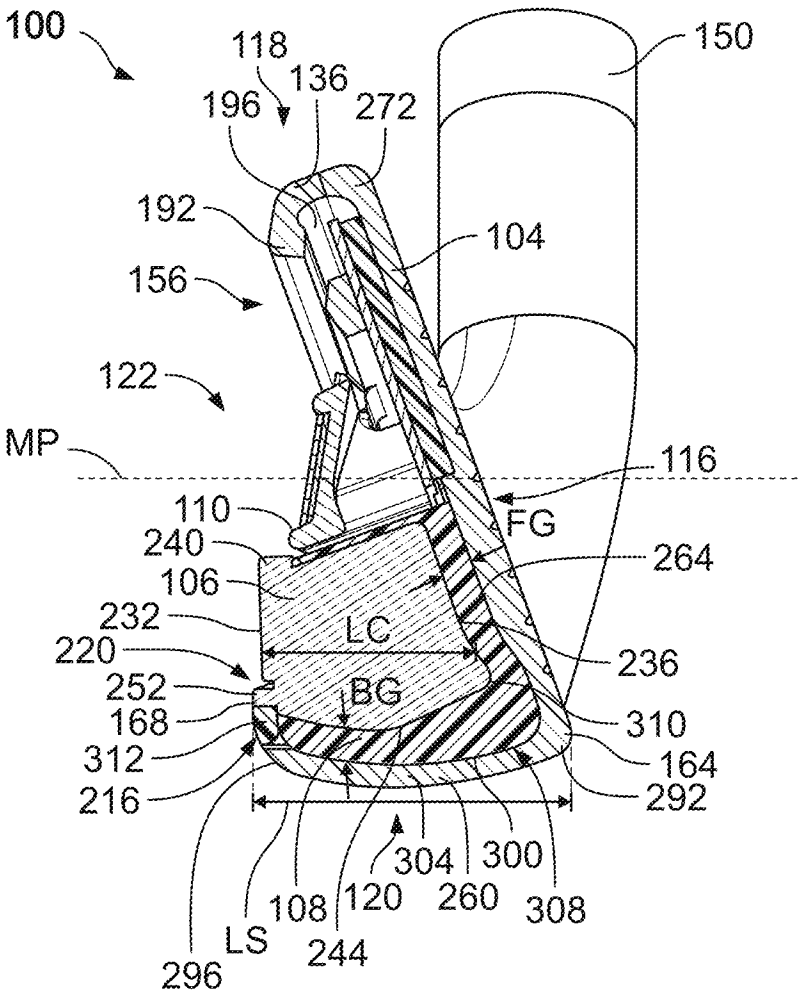
FIG. 8 is a cross-sectional view taken through the line 8-8 of FIG. 2.

In general, the rear side 122 of the body 102 includes a slot 216 formed along the trailing end 168, as illustrated in FIG. 4. In some embodiments, the slot 216 is formed by mechanical fabrication involving the removal of material from the body 102. For example, the slot 216 may be formed by use of a CNC milling machine, a router, laser cutting, or the like. In some embodiments, the slot 216 is formed integrally with the body 102 by casting, forging, molding, or the like. The slot 216 extends from the heel region 128 to the toe region 124 of the body 102. In some embodiments, the slot 216 extends continuously along the medial region 126 of the body 102. Further, the slot 216 is in at least partial communication with the sole cutout 152 along the medial region 126 of the body 102, such that the slot 216 and the sole cutout 152 are fluidly connected. Referring specifically to FIG. 4, the sole cutout 152 defines a width WS1 between the toe receiving edge 180 and the heel receiving edge 172 on the bottom side 120 of the body 102. Further, the slot 216 defines a width WS2 along the trailing end 168 of the body 102. In the illustrated embodiment, the width WS2 of the slot 216 is greater than the width WS1 of the sole cutout 152. In some embodiments, the width WS2 of the slot 216 is equal to or less than the width WS1 of the sole cutout 152. The width WS1 of the sole cutout 152 may vary between the leading end 164 and the trailing end 168 of the body 102. In some embodiments, the width WS1 of the sole cutout 152 measured at the leading end 164 is greater than the width WS2 of the slot 216. Additionally, the slot 216 defines a height HS1 between the sole surface 160 and the rear core surface 232 at the trailing end 168 of the iron-type golf club head 100. In the illustrated embodiment, the height HS1 of the slot 216 within the heel region 128 is generally equal to the height HS1 of the slot 216 in the toe region 124. In some embodiments, the height HS1 of the slot 216 varies along from the heel region 128 to the toe region 124. Further, the height HS1 of the slot 216 within the medial region 126 is at least partially defined by the arrangement of the sole return 260 when the face insert 104 is coupled to the body 102, as illustrated in FIG. 8.

Still referring to FIG. 4, a notch 220 is formed on the rear side 122 of the body 102 at or near the trailing end 168 and a plate 224 is received by the notch 220. Further, the notch 220 is formed at least partially along the core bar 106 within the medial region 126 of the body 102. In the illustrated embodiment, notch 220 is irregularly shaped, although other configurations are contemplated. The notch 220 is in communication with the body cutout 156 on the rear side 122 of the body 102. The plate 224 is configured to fit within the notch 220 and, thus, the plate 224 is configured to have a shape that conforms to a shape of the notch 220. In some embodiments, the plate 224 is a medallion formed from a metal or metal alloy, e.g., aluminum, or a polymer, e.g., thermoplastic polyurethane (TPU), or a combination thereof. Further, the plate 224 may be secured to the body 102 and/or the face insert 104 by way of adhesion, e.g., tape, glue, cement, etc., or by fasteners, or welding, or fusion, or the like.

Referring to FIGS. 3 and 4, the core bar 106 extends from the heel region 128 to the toe region 124. In some embodiments, the core bar 106 is suspended across the body 102. For example, an interface between the core bar 106 and the body 102 is limited to opposing ends of the core bar 106 in the heel region 128 and the toe region 124. In some examples, the core bar 106 is welded to the body 102 at opposing ends. The core bar 106 extends continuously along the medial region 126. The core bar 106 includes a rear core surface 232 on the rear side of the body 102 and a front core surface 236 near a front side of the body 102. That is, the rear core surface 232 is disposed opposite the front core surface 236. In the illustrated embodiments, the front core surface 236 is curved and includes a particular contour that is configured to conform to the face insert 104 when coupled to the body 102. The core bar 106 further includes an upper core surface 240 that extends between the heel region 128 and the toe region 124, along the medial region 126, of the body 102. The upper core surface 240 curves between the heel region 128 and the toe region 124 of the body 102, such that the upper core surface 240 is curved concavely relative to the ground plane GP when the iron-type golf club head 100 is at address (see FIG. 2). Further, the core bar 106 includes a bottom core surface 244 that extends from the heel region 128 to the toe region 124, along the medial region 126, of the body 102. The bottom core surface 244 curves between the heel region 128 and the toe region 124, such that the bottom core surface 244 is curved convexly relative to the ground plane GP. Further, the bottom core surface 244 is curved concavely in the front-to-rear direction, as illustrated in FIG. 8. Referring to FIGS. 3 and 4, the core bar 106 further includes a toe core surface 248 that extends from the medial region 126 to the toe region 124 of the body 102 and is at last partially configured to face the toe inner surface 200 of the body 102. The toe core surface 248 spans between the bottom core surface 244 and the upper core surface 240 and between the front core surface 236 and the rear core surface 232. As illustrated in FIG. 3, the front core surface 236 curves forwardly from the upper core surface 240 to the bottom core surface 244.

With reference to FIG. 4, the rear core surface 232 of the core bar 106 includes a ledge 252 that defines a portion of the notch 220 at the trailing end 168 of the body 102. The ledge 252 curves as it extends generally laterally along the medial region 126 of the body 102. The ledge 252 and the slot 216 are generally coextensive and run parallel with one another, and the ledge 252 at least partially defines the slot 216. In particular, the ledge 252 of the core bar 106, which is a lower edge of the rear core surface 232, forms an upper edge of the slot 216 at the trailing end 168 of the body 102. Accordingly, the slot 216 is spaced apart from the notch 220, and the ledge 252 is disposed between the slot 216 and the notch 220.

Referring to FIG. 5, the filler material 108 is disposed within the body 102. The filler material 108 may be a polymer material, e.g., rubber, thermoplastic resin, or the like. It is contemplated that the filler material 108 has a Shore A hardness of between about 20 Shore A and about 50 Shore A, or between about 25 Shore A and about 45 Shore A, or between about 30 Shore A and about 40 Shore A. In some embodiments, the filler material 108 has hardness of about 35 Shore A. The filler material 108 is configured to at least partially surround the core bar 106 of the body 102. In some embodiments, the filler material 108 is arranged to cover the front core surface 236, the bottom core surface 244, and the toe core surface 248. Accordingly, the filler material 108 is configured to cover at least three surfaces of the core bar 106, e.g., the bottom core surface 244, the front core surface 236, and the toe core surface 248. In some embodiments, the filler material 108 is arranged to cover a portion of the upper core surface 240. In addition, the filler material 108 may only partially cover the front core surface 236 and/or the toe core surface 248. In the illustrated embodiments, the filler material 108 is configured to conform to the shape of the front core surface 236 and the face insert 104. In some embodiments, the filler material 108 extends into the sole cutout 152. In some embodiments, the filler material 108 extends along the heel region 128, the medial region 126, and the toe region 124 of the body 102. The filler material 108 may be coextensive with the core bar 106 in both the heel region 128 and the toe region 124 of the body 102. The filler material 108 is configured to be disposed in the lower segment 208 of the body 102. In some embodiments, the filler material 108 is at least partially disposed in the upper segment of the body 102.

Figure 6:
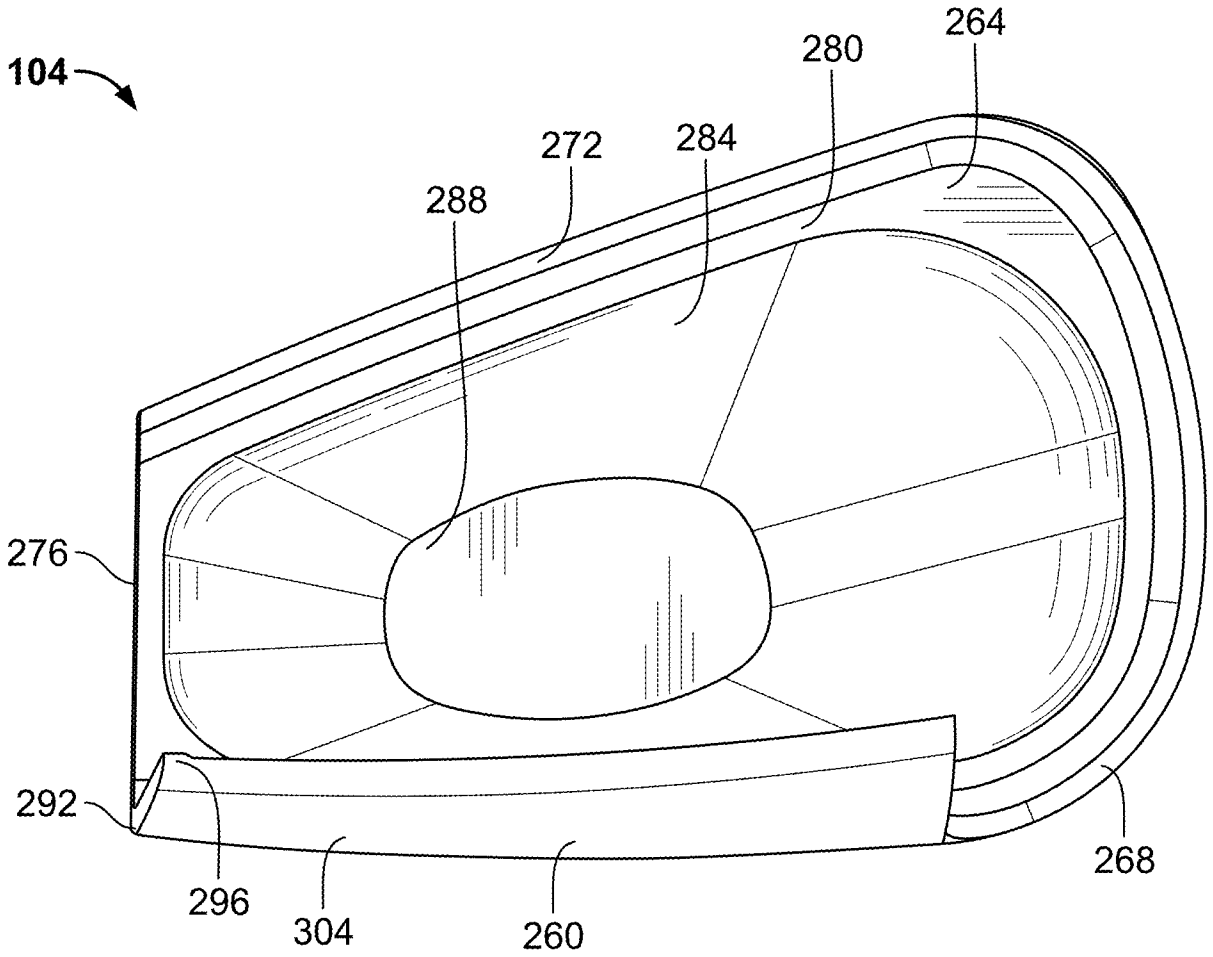
FIG. 6 is a rear elevational view of the face insert of the club head of FIG. 1.
Figure 7:
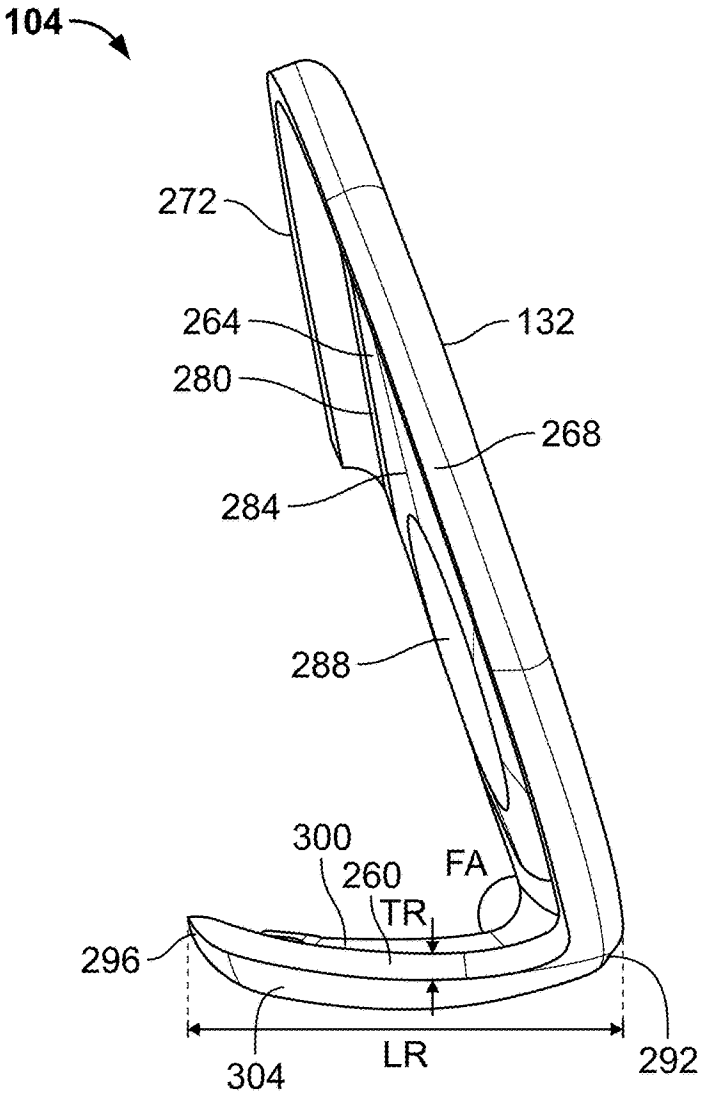
FIG. 7 is a rear and left isometric view of the face insert of FIG. 6.

Referring to FIGS. 6 and 7, the face insert 104 includes a sole return 260 and an inner surface 264 that comprises a toe peripheral edge 268, a top peripheral edge 272, and a heel peripheral edge 276. The toe peripheral edge 268 extends generally vertically in an arcuate path form the sole return 260 to the top peripheral edge 272. The heel peripheral edge 276 extends generally vertically from the sole return 260 to the top peripheral edge 272. Further, the top peripheral edge 272 is sloped vertically and laterally as it extends from the heel peripheral edge 276 to the toe peripheral edge 268. In some embodiments, the sole return 260 is attached or coupled to the face insert 104. In some embodiments, the face insert 104 and the sole return 260 may be formed as a unitary component by various manufacturing methods, e.g., casting, forging, additive manufacturing, or the like. Accordingly, the face insert 104 may be composed of a metal or metal alloy, such as, e.g., Grade 17-4 Stainless Steel. It is contemplated that the face insert 104 may have a hardness, as measured using the Rockwell Scale C, of between about 25 HRC and about 55 HRC, or between about 30 HRC and about 50 HRC, or between about 36 HRC and about 42 HRC.

In the illustrated embodiment, the face insert 104 has a variable thickness, such that a distance between the front face 132 and the inner surface 264 varies along the face insert 104. Referring specifically to FIG. 6, the face insert 104 includes a border zone 280 that has a first thickness, an intermediate zone 284 that is disposed concentrically within the border zone 280 and that has a second thickness, and a central zone 288 that is disposed concentrically within the intermediate zone 284 and that has a third thickness. Accordingly, the central zone 288 is surrounded by the intermediate zone 284 and the intermediate zone 284 is surrounded by the border zone 280. Put another way, the central zone 288 the intermediate zone 284 and the border zone 280 are arranged concentrically on the inner surface 264 of the face insert 104. In some embodiments, the third thickness of the central zone 288 is greater than the second thickness of the intermediate zone 284, and the first thickness of the border zone 280 In some embodiments, the second thickness of the intermediate zone 284 is less than the third thickness of the central zone 288 but greater than the first thickness of the border zone 280 Put another way, the inner surface 264 of the face insert 104 increases in thickness concentrically moving in an inward direction toward the central zone 288. In some embodiments, the first thickness of the border zone 280 is between about 1.0 mm and about 2.0 mm, or between about 1.2 mm and about 1.8 mm, or between about 1.4 mm and about 2.6 mm. In some embodiments, the first thickness of the border zone 280 is about 1.5 mm. In some embodiments, the second thickness of the intermediate zone 284 is between about 1.0 mm and about 3.0 mm, or between about 1.3 mm and about 2.8 mm, or between about 1.5 mm and about 2.6 mm. In some embodiments, the third thickness of the central zone 188 is between about 1.5 mm and about 3.0 mm, or between about 1.7 mm and about 2.8 mm, or between about 2.0 mm and about 2.6 mm.

Referring to FIGS. 6 and 7, the sole return 260 extends outwardly away from the inner surface 264 at a lower end of the face insert 104. The sole return 260 extends from a leading edge 292 that is proximate the inner surface 264 to a trailing edge 296 that is distal or spaced apart from the inner surface 264. Referring specifically to FIG. 7, the leading edge 292 is where the sole return 260 extends from the face insert 104. The sole return 260 has a return length LR that is defined between the leading edge 292 and the trailing edge 296. The return length LR may vary along the sole return 260 in the lateral direction between the heel peripheral edge 276 and the toe peripheral edge 268. Additionally, the sole return 260 has a return thickness TR between an inner return surface 300 and an outer return surface 304. The minimum return thickness TR may be disposed along the leading edge 292 to allow for increased flexibility of the face insert 104 in a hinge-like manner about the leading edge 292. The return thickness TR may vary along the sole return 260 in the lateral direction between the heel peripheral edge 276 and the toe peripheral edge 268. Further, the return thickness TR may vary along the sole return 260 in the front-rear direction between the leading edge 292 and the trailing edge 296. In some embodiments, the return thickness TR may be uniform along the sole return 260 between the trailing edge 296 and the leading edge 292. In some embodiments, the return thickness TR may be equal to a thickness of the sole surface 160 of the body 102. In some embodiments, the return thickness TR is less than the thickness of the sole surface 160 of the body 102, particularly when the sole return 260 is composed of a stronger, denser material than a material of the body 102. In some embodiments, the return thickness of the sole return 260 is between about 1.0 mm and about 2.0 mm, or between about 1.2 mm and about 2.8 mm, or between about 1.4 mm and about 2.6 mm. In some embodiments, the return thickness TR is about 1.5 mm. In the illustrated embodiment, the sole return 260 may be cup-shaped and conforms to the shape of the sole cutout 152 of the body 102, although other configurations are possible. A sole return angle FA is defined between the inner return surface 300 of the sole return 260 and the inner surface of the face insert 104. Preferably, the sole return angle FA corresponds with the loft angle of the iron-type golf club head 100.

Referring to FIGS. 1 and 8, the sole return 260 is configured to fit within the sole cutout when the face insert 104 is coupled to the body 102. In particular, the trailing edge 296 of the sole return 260 is configured to be disposed at or near the trailing end 168 of the body 102 on the rear side 122 of the iron-type golf club head 100. Further, the leading edge 292 of the sole return 260 is configured to be disposed at or near the leading end 164 of the body 102. As will be appreciated from FIGS. 1, 3, and 8, the face insert 104 and the body 102 are coupled together along the interface formed between the toe receiving edge 180 and the toe peripheral edge 268, the heel receiving edge 172 and the heel peripheral edge 276, and the top receiving edge 184 and the top peripheral edge 272. Accordingly, the sole return 260 spans the width WS1 of the sole cutout 152 between the heel receiving edge 172 and the toe receiving edge 180. In addition, the trailing edge 296 of the sole return 260 extends up to and is disposed coextensive with the slot 216 on the trailing end of the body 102. Accordingly, the slot 216 is disposed between the core bar 106, specifically the ledge 252 on the rear surface of the core bar 106, and the trailing edge 296 of the sole return 260. That is, an upper edge of the slot 216 is formed by the ledge 252, or lower edge, of the core bar 106 and a lower edge of the slot 216 is formed by the trailing edge 296 of the sole return 260. As a result, the trailing edge 296 of the sole return 260 at least partially defines the height HS1 (see FIG. 4) of the slot 216 within the medial region 126 of the iron-type golf club head 100. With the trailing edge 296 of the sole return 260 spaced apart a distance, e.g., the height HS1 of the slot 216, from the core bar 106 at the trailing end 168 of the iron-type golf club head 100, the sole return 260 of the face insert 104 is configured to be more flexible than conventional golf club heads.

With reference to FIG. 8, an interior cavity 308 is formed between the face insert 104 the body 102. In particular, the interior cavity 308 is formed between the face insert 104 and the core bar 106. In some embodiments, the interior cavity 308 is formed by the inner surface 264 of the face insert 104, the inner return surface 600 of the sole return 260, the bottom core surface 244, the front core surface 236, and the toe inner surface 200 of the body 102. The interior cavity 308 extends along the heel region 128, the medial region 126, and the toe region 124. Further, the interior cavity 308 is a volume in which the filler material 108 is disposed within the iron-type golf club head 100. Accordingly, the inner return surface 600 of the sole return 260 is spaced apart from the bottom core surface 244 of the core bar 106 along the length LR of the sole return 260. Likewise, the inner surface 264 of the face insert 104 is spaced apart from the front core surface 236 of the core bar 106. It is contemplated that ribs or posts (not shown) may be disposed within the interior cavity 308. For example, ribs or projections (not shown) may extend from and along the inner return surface 300 or the inner surface 264 of the face insert 104, the core bar 106, or another portion of the body 102.

With continued reference to FIG. 8, a front gap distance FG of a front gap of the interior cavity 308 may be defined between the front core surface 236 of the core bar 106 and the inner surface 264 of the face insert 104. A bottom gap distance BG of a bottom gap of the interior cavity 308 may be defined between the bottom core surface 244 of the core bar 106 and the inner return surface 300 of the sole return 260. In the illustrated embodiment, the front gap distance FG is generally uniform between the core bar 106 and the face insert 104 due, at least partially, to the conforming shapes of the front core surface 236 and the inner surface 264 of the face insert 104. In some embodiments, the front gap distance FG varies along the core bar 106 and/or the face insert 104, such as, e.g., laterally between the heel region 128 and the toe region 124, or vertically between the upper core surface 240 and the bottom core surface 244, or a combination thereof. Further, the bottom gap distance BG decreases in the front-rear direction from the front core surface 236 and the slot 216. Accordingly, the bottom gap distance BG may be greater than the front gap distance FG at a point near the front core surface 236 and, also, the bottom gap distance BG may be equal to or less than the front gap distance FG at a point near the slot 216. It is contemplated that the front gap distance FG may vary between about 40% and about 100% of the bottom gap distance BG. Further, the bottom gap distance BG near the slot 216 may be less than the height HS1 of the slot 216 (see FIG. 4) within the medial region 126, the toe region 124, and/or the heel region 128 of the iron-type golf club head 100. In some embodiments, the bottom gap distance BG varies along the medial region 126 between the heel region 128 and the toe region 124 of the iron-type golf club head 100. In some embodiments, the bottom gap distance BG is uniform in the front-rear direction, or the heel-toe direction, or both.

A head sole length LS is defined between the front face 132 at the leading end 164 of the head 100 and the rear core surface 232 at the trailing end 168 of the iron-type golf club head 100. Accordingly, the head sole length LS is approximately equal to a distance between the slot 216 at the trailing end 168 and the front face 132 at the leading end 164. In some embodiments, the head sole length LS is greater than the return length LR of the sole return 260. In some embodiments, the return length LR comprises between about 75% and about 99% of the head sole length LS, or between about 80% and about 95% of the head sole length LS, or between about 85% and about 90% of the head length LS. It has been found that the flexibility of the face insert 104 increases in proportion to the thickness and extension of the sole return 260 of the face insert 104 from the leading end 164 to or near the trailing end 168, such that decreasing the return thickness TR and increasing the return length LR increase the flexibility of the face insert 104. In some embodiments, providing the return thickness TR of the sole return 260 to be equal to or less than the thinnest portion, e.g., the first thickness of the border zone 280, and providing the return length LR to be greater than 50% of the head sole length LS increases the flexibility of face insert 104 at impact. This flexibility is further improved or enhanced by the thin, peripheral interface along which the face insert 104 is joined to the body 102. In this way, the face insert 104 is coupled to the relatively thin portions of the body 102, e.g., the receiving edges 172, 180, and 184, and decoupled or distanced from the thickest portion, e.g., the core bar 106, of the body 102.

The core bar 106 is sized and shaped to contain a core mass CM that comprises greater than 50% of a body mass BM of the body 102. In this way, the portions of the body 102 that surround the core bar 106 can be made flexible and thin, while the core bar 106 is stiffened and thick. At the same time, the core bar 106 and the body 102 are configured to concentrate the body mass BM and core mass CM in the heel region 128 and the toe region 124, which increases a moment of inertia MOI of the iron-type golf club head 100. Additionally, the core bar 106 is located within the body 102 to distribute and position the core mass CM downwardly toward the sole 140 on the bottom side 120 and rearwardly toward the rear side 122 of the iron-type club head 100, which also moves a center of gravity CG of the iron-type golf club head 100 downward and rearward. Accordingly, the core bar 106 is located entirely within the lower segment 208 of the body 102. Further, the core bar 106 is located below a mid-plane MP defined between the topline 136 and the sole 140 of the iron-type golf club head 100, as illustrated in FIG. 8. In general, the mid-plane MP is disposed approximately centrally between the topline 136 and the sole 140 within the medial region 124. Further, the sole return 260 and the core bar 106 are configured to have corresponding properties, e.g., size, shape, mass, material. Accordingly, the return thickness TR is configured to be sized to correspond with the dimensions of the core bar 106 to maintain the bottom gap distance BG, which may allow the core bar 106 to be increased in size below the mid-plane MP to distribute and position the core mass CM downwardly toward the sole 140 and rearwardly toward the rear side 122.

Further, a core bar length LC is defined between the rear core surface 232 and the front core surface 236. The core bar length LC varies along the core bar 106 between the upper core surface 240 and the bottom core surface 244. In the illustrated embodiment, the core bar length LC is less than the head sole length LS. In this way, the mass of the core bar 106 is concentrated rearwardly (e.g., toward or near the rear side 122) on the iron-type club head 100, which distances a club head center of gravity CG from the front face 132 and, thus, improves balance when swinging the iron-type golf club head 100. In some embodiments, the core bar length LC comprises between about 50% and about 90% of the head sole length LS, or between about 60% and about 80% of the head sole length LS, or between about 65% and about 75% of the head sole length LS. In some embodiments, the core bar length LC is approximately equal to the return length LR. In some embodiments, the core bar length LC is less than the return length LR. The core bar 106 further defines a forwardmost point 310 that is disposed closest to the leading end 164 on the front side 116 of the iron-type golf club head 100 relative to the remainder of the core bar 106. As such, the forwardmost point 310 may be located between about 5% and about 50% of the length LS from the leading end 164, or between about 10% and about 40%, or between about 15% and about 30%. In some embodiments, the forwardmost point 310 of the core bar 106 is located at about 25% of the length LS from the leading end 164.

As illustrated in FIG. 8, the slot 216 may include a slot filler material 312 therein. In some embodiments, the slot 216 is at least partially filled with the slot filler material 312. For example, the slot filler material 312 may be poured or injected into the slot 216 and allowed to harden or set. In some embodiments, the slot 216 is entirely filled by the slot filler material 312. The slot filler material 312 may be a polymer, such as, e.g., a jet weld material. It is contemplated that the slot filler material 312 has a Shore A hardness of between about 80 Shore A and about 110 Shore A, or between about 85 Shore A and about 105 Shore A, or between about 90 Shore A and about 100 Shore A. In some embodiments, the slot filler material 312 has hardness of about 95 Shore A. The slot filler material 312 may be different from the filler material 108 disposed within the interior cavity 308 of iron-type golf club head 100. The slot filler material 312 and the filler material 108 may be in contact with one another, as a result of the slot 216 and the interior cavity 308 being in fluid communication with one another.

It is contemplated that the filler material 108 disposed inside the iron-type golf club head 100 between the core bar 106 and the face insert 104 provides several advantages. In some embodiments, the interior cavity 308 is at least partially filled with the filler material 108. For example, the filler material 108 may be poured or injected into the interior cavity 308 and allowed to harden or set. In some embodiments, the interior cavity 308 and any voids or gaps thereof are entirely filled with filler material 108. For example, when the iron-type golf club head 100 strikes a golf ball 320 (see FIG. 17), the face insert 104 elastically deforms in a manner that causes displacement and compression of the filler material 108. Accordingly, interaction between the filler material 108 and the face insert 104 during impact results in, e.g., improved sound attenuation and increased kinetic energy return. Conventional, hollow golf club heads with empty internal volumes produce a loud, reverberating sound, often at high pitches or frequencies, which golfers may find unsuitable, especially when such sound is noticed by other players or detected during televised play. By contrast, the iron-type golf club head 100 of the present disclosure produces an attenuated or muffled sound at a lower pitch or frequency during impact with a golf ball, at least partially due to filler material 108 occupying the interior cavity 308 to absorb the sound waves and, thus, preventing a lack of empty volume within the interior cavity 308 in which sound may reverberate. Further, the face insert 104 is configured to elastically deform or flex during impact with a golf ball, while the filler material 108 absorbs and returns kinetic energy caused by compression between the deformed face insert 104 and the core bar 106 within the interior cavity 308. That is, the filler material 108 prevents direct contact between the face insert 104 and the core bar 106 due to its position therebetween, while still permitting the face insert 104 to flex at impact, and the filler material 108 improves energy return with spring-like performance due to the material properties, e.g., the reduced Shore A hardness. In this way, kinetic energy is returned to the face insert 104 for transfer to the golf ball, rather than merely being absorbed within the interior cavity 308 or stifled by the relatively stiff, inflexible body 102, and particularly the inflexible core bar 106, of the iron-type golf club head 100.

Additionally, vibrations are felt by the golfer through a shaft (not shown) that is connected to the body 102 by the hosel 150. Such vibrations, which are often referred to as the "feel" of the club, may be amplified in intensity and duration by conventional, hollow golf club heads. However, the filler material 108 of the iron-type golf club head 100 of the present disclosure absorbs vibrations during impact, resulting in a softened feel that is preferred by golfers. Further, the feel of the iron-type golf club head 100 may be customized to suit the desire of the golfer by varying the filler material 108 material properties, amount, arrangement, and displacement within the iron-type golf club head 100. In a similar manner, the slot filler material 312 affords for sound attenuation, kinetic energy return, and improved feel of the iron-type golf club head 100 by allowing the sole return 260 of the face insert 104 to be displaced while acting as a cushion between the sole return and the core bar 106 of the body 102. Further, because of the position and material properties of the filler material 108 and the slot filler material 312, when the face insert 104 elastically deforms during impact with the golf ball 320, the face insert 104 does not directly contact the core bar 106 and is dampened to reduce or prevent continued flexing and vibration after impact. More specifically, the inner surface 264 of the face insert 104 does not directly contact the front face 132 of the core bar 106, in part due to the filler material 108 disposed therein and also in part due to the front gap distance FG provided between the face insert 104 and the core bar 106. Accordingly, the core bar 106 is configured to be suspended within the body 102 of the iron-type golf club head 100 and decoupled from direct contact with the face insert 104 in both impact and rest states. It will be appreciated that the core bar 106 is suspended within the body 102 and distanced from the face insert 104 within the entire medial region 126 of the iron-type golf club head 100, although other configurations are possible. Further, the core bar 106 is suspended within the body 102 and distanced from the face insert 104 within at least a portion of the heel region 128 and the toe region 124. In this way, the face insert 104 is prevented from direct contact with the most inflexible portion of the body 102, e.g., the core bar 106.

FIGS. 9-16 depict another embodiment of a golf club head 400, such as an iron-type golf club head, having a face insert 404 and a body 402. In this embodiment, elements that are shared with, i.e., that are structurally and/or functionally identical to, elements present in the first embodiment (iron-type golf club head 100) are represented by reference numerals increased by a value of three-hundred (300). It will be appreciated that the iron-type golf club head 400 may be similar to the iron-type golf club head 100, except as described below or apparent from the figures.

Figure 10:
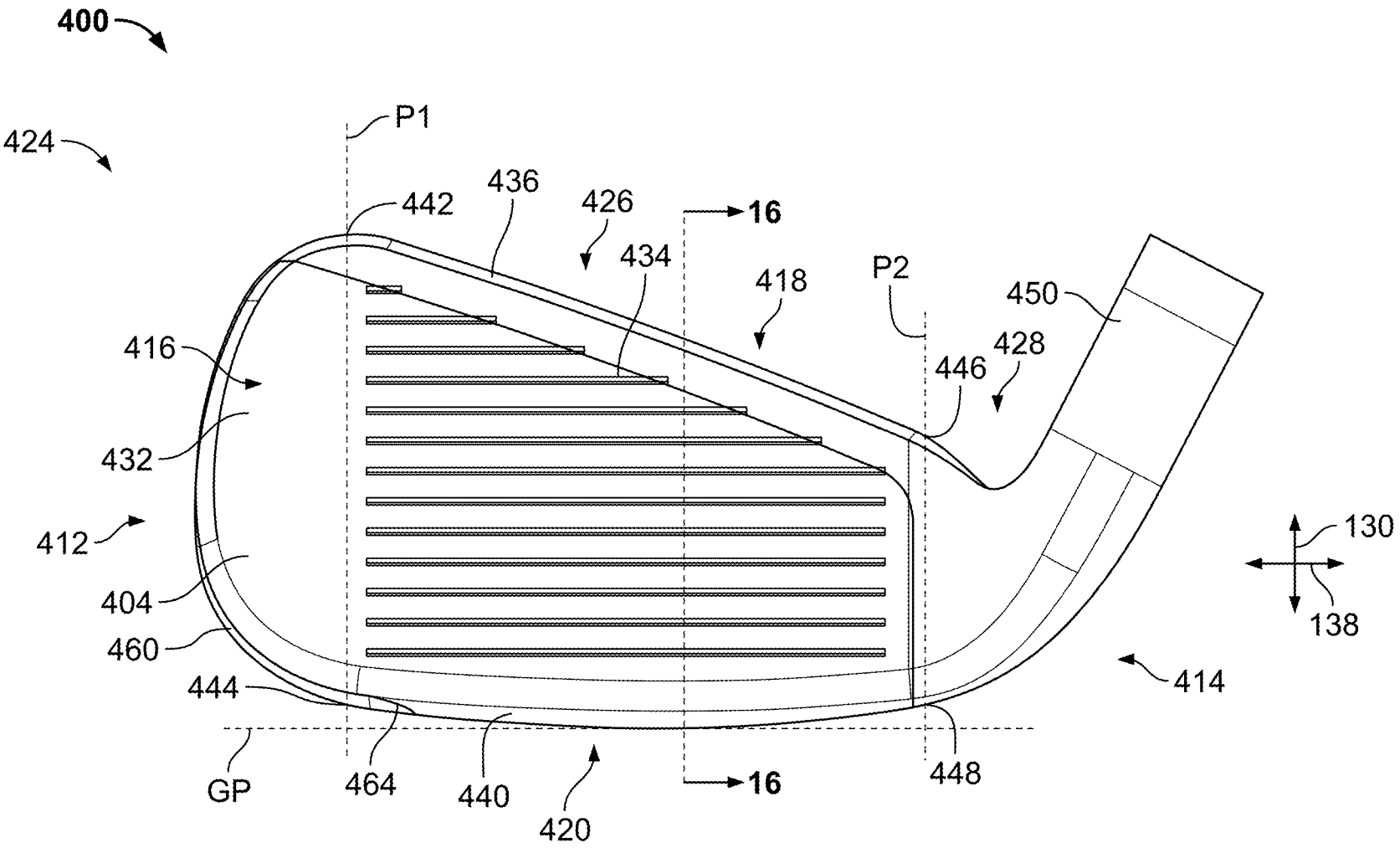
FIG. 10 is a front elevational view of the club head of FIG. 9.

Referring specifically to FIG. 10, the face insert 404 may be coupled to the body 402 to form a flexible striking face and after machining of the body 402. In some embodiments, the face insert 404 may be manufactured from different metal or non-metallic materials (e.g., different types of stainless steel, polymer, or carbon composite). The body 402 includes a body weight bar or core bar 406 that may be fabricated from the same type of material (e.g., the same type of stainless steel). In some embodiments, the core bar 406 may be fabricated from a material with a higher density than the rest of the body 402 (e.g., a tungsten core and a stainless steel body). In some embodiments, the core bar 406 may be fabricated from a material with a lower density than the rest of the body 402. When the iron-type golf club head 400 is assembled, the core bar 406 is partially surrounded by a filler material 408 and a medallion 410 is attached to a side of the body 402 that is opposite to the face insert 404 (e.g., a rear side of the body 402). In some embodiments, the medallion 410 is formed from a metal or metal alloy, e.g., aluminum, or a polymer, e.g., thermoplastic polyurethane (TPU), or a combination thereof. Further, the medallion 410 may be secured to the body 402 and/or the face insert 404 by way of adhesion, e.g., tape, glue, cement, etc., or by fasteners, or welding, or fusion, or the like.

Figure 9:
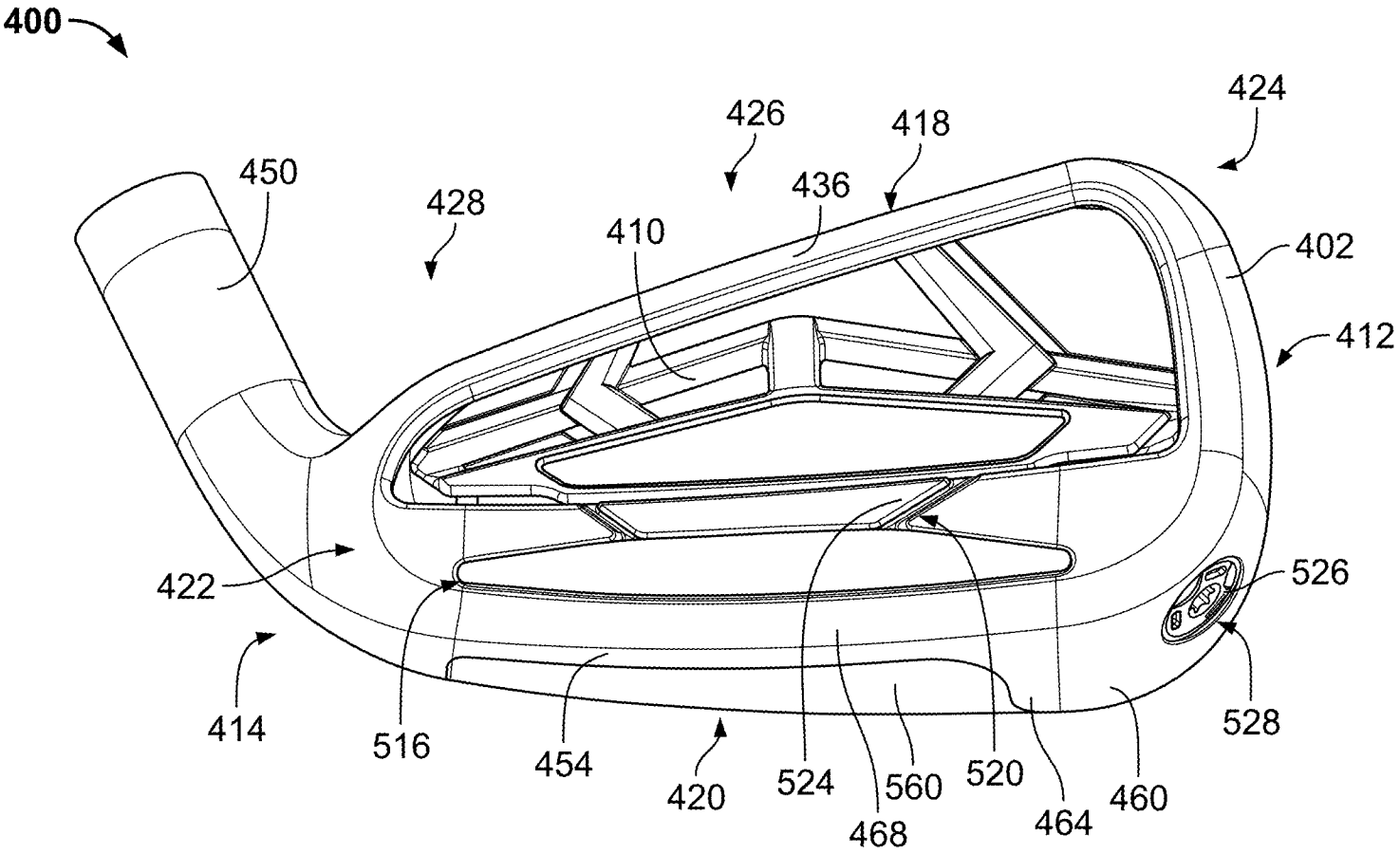
FIG. 9 is a rear, bottom, and left isometric view of another golf club head, according to an embodiment of the present disclosure.

The iron-type golf club 400 defines a toe side 412, a heel side 414, a front side 416 (see FIG. 10), a top side 418, a bottom side 420, and a rear side 422 (see FIG. 9). The iron-type golf club head 400 further includes a toe region 424, a medial region 426, and a heel region 428. Referring specifically to FIG. 10, the planes P1 and P2 may define the toe region 424, the heel region 428, and the medial region 426. The planes P1 and P2 extend through the iron-type golf club head 400 in the sole-topline direction or vertical direction.

The face insert 404 is attached to the front side 416 of the body 402, and a face surface or front face 432 is defined by the face insert 404 and the body 402 within the toe region 424, the medial region 426, and at least proximate a junction between the heel region 428 and the medial region 426. The front face 432 includes the plurality of laterally-extending grooves 434 that are spaced from one another in the sole-topline direction 130. In some embodiments, the front face 432 may define a striking face that makes contact with a golf ball.

The iron-type golf club head 400 defines a topline 436 extending in the inclined heel-toe direction or lateral direction 138 along the top side 418, and a sole 440 extending laterally in the heel-toe direction 138 along the bottom side 420. The topline 436 may be formed by the top side 418 of the body 402, the face insert 404, or a combination of the body 402 and the face insert 404. Similarly, the sole 440 may be formed by the bottom side 420 of the body 402, the face insert 404, or a combination of the body 402 and the face insert 404.

The topline 436 may extend along the top side 418 from the toe-topline intersection point 442, along the medial region 426, to the heel-topline inflection point 446. The sole 440 may extend along the bottom side 420 from the toe-sole intersection point 444, along the medial region 426, to the heel-sole inflection point 448.

In some embodiments, the plane P1 may be defined along or proximate a lateral edge of the grooves 434 formed in the front face 432 that is adjacent to the toe side 412. In the illustrated embodiment, the plane P1 may intersect the top side 418 of the body 402 or the face insert 404 at the toe-topline intersection point 442 along the topline 436 where the slope of a line tangent to the topline 436 is approximately zero (e.g., a point where a line tangent to the periphery of the top side 418 is approximately parallel to the ground at address). In this embodiment, the plane P1 may extend through the iron-type golf club head 400 in the sole-topline direction 130 to the toe-sole intersection point 444 along the bottom side 420.

In some embodiments, the plane P2 may be defined along or proximate a lateral edge of the grooves 434 formed in the front face 432 that is adjacent to the heel side 414. In some embodiments, the plane P2 may be defined by the intersection between a lateral edge of the face insert 404 adjacent to the heel side 414 and the body 402. In the illustrated embodiment, the plane P2 may intersect the top side 418 of the body 402 or the face insert 404 at the heel-topline inflection point 446 (e.g., a point where the periphery of the top side 418 transitions from concave down to concave up). In this embodiment, the plane P2 may extend through the iron-type golf club head 400 in the sole-topline direction 130 to the heel-sole inflection point 448 along the bottom side 420.

Figure 11:
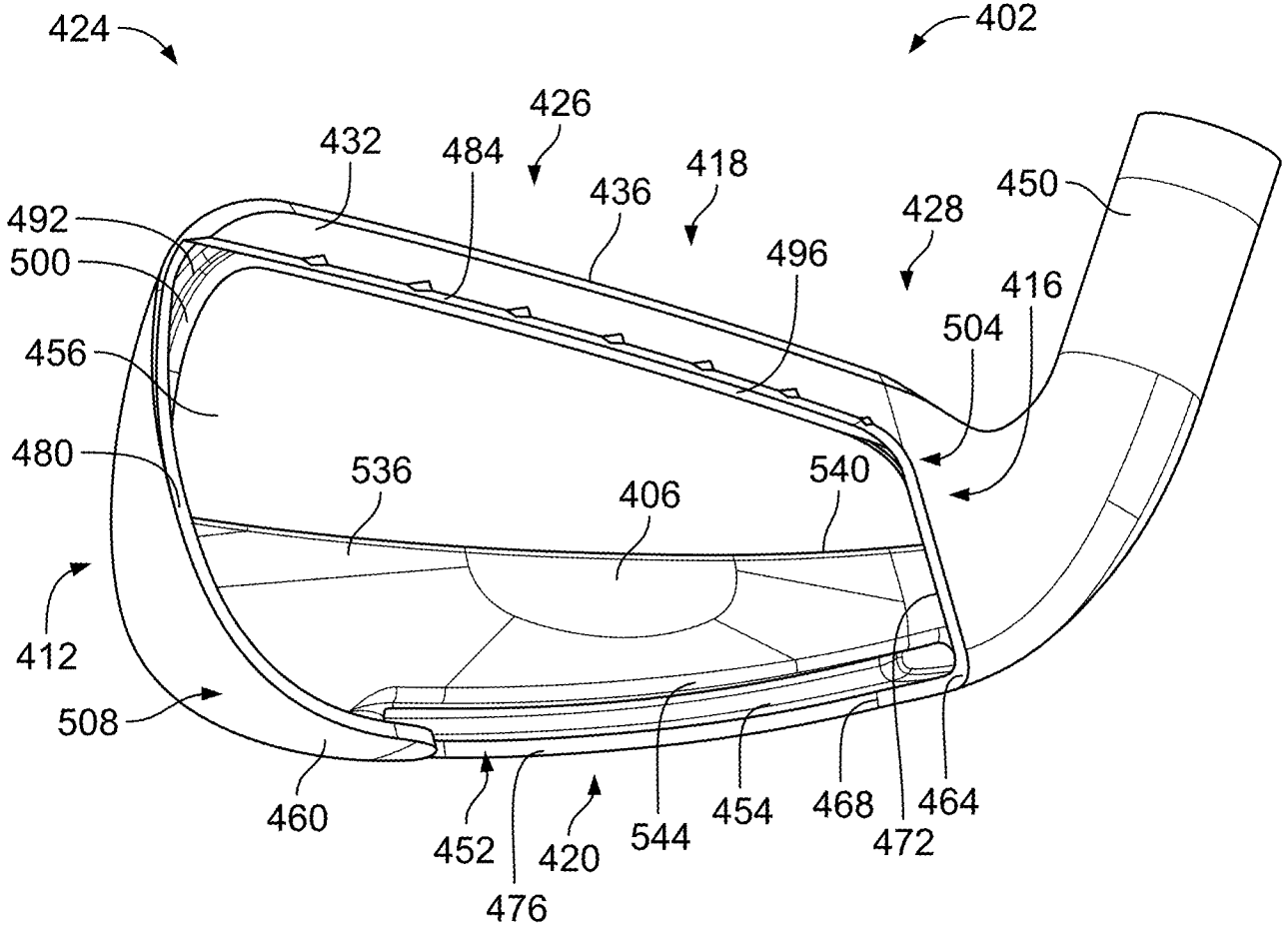
FIG. 11 is a front and left isometric view of a body of the club head of FIG. 9.

With reference to FIG. 11, the body 402 may be formed as a unitary component (e.g., from a single piece of material). In some embodiments, the body 402 may be formed by a casting process, a forging process, an additive manufacturing process (e.g., 3-D printing, such as DMLS). Accordingly, the body 402 may be made of a metal or metal alloy, such as, e.g., Grade 431 Stainless Steel. It is contemplated that the body 402 may be formed of a material having a hardness, as measured in accordance with the Rockwell Scale C, of between about 15 HRC and about 25 HRC, or between about 17 HRC and about 23 HRC, or between about 19 HRC and about 21 HRC. In some embodiments, the body 402 has a hardness of about 20 HRC. The body 402 includes the core bar 406, a hosel 450, a sole cutout 452, a sole member 454, and a body cutout 456 that extends through the body 402. The hosel 450 is arranged within the heel region 428 of the body 402 and extends from the heel region 428 at an angle (e.g., a lie angle formed between a plane parallel to the ground plane on which the club head rests at address and a center axis defined through the hosel 450) in a direction away from the toe region 424.

In general the sole cutout 452 is formed on the bottom side 420 of the body 402 and extends along the medial region 426 of the body 402. In particular, the sole cutout 452 is formed in the sole surface 460 of the body 402 and extends in the front-rear direction between a leading end 464 and the sole member 454 at a trailing end 468 of the body 402. In the illustrated embodiment, the leading end 464 is arranged on the front side 416 of the body 402 and is configured to be coextensive with the front face 432. Further, the trailing end 468 is arranged on the rear side 422 of the body 402 opposite the leading end 464. The sole member 454 extends along the sole 440 on the bottom side 420 of the body 402 and within the medial region 426. In some embodiments, the sole member 454 extends between the heel region 428 and the toe region 424 of the body 402. The sole member 454 is configured to be distanced from the core bar 406 of the body 402, as illustrated in the FIGS. 12 and 16.

Additionally, the body 402 is configured to receive the face insert 404 to form the club head 400. Accordingly, the body 402 includes the heel receiving edge 472 that extends generally vertically downwardly in the sole-topline direction 130 from the topline 436 to the sole surface 460 before curving rearward and extending generally horizontally from the leading end 464 to the trailing end 468 on the bottom side 420 of the body 402. The toe receiving edge 480 extends in a generally arcuate path vertically upwardly in the sole-topline direction 130 from the sole surface 460 toward the topline 436 before sharply turning heelward to meet with the top receiving edge 484. The top receiving edge 484 extends generally laterally (e.g., in the heel-toe direction 138) from the heel receiving edge 472 to the toe receiving edge 480 along the front side 416 of the body 402 near the top side 418. In the illustrated embodiment, the top receiving edge 484 is angled and slopes downwardly from the toe receiving edge 480 to the heel receiving edge 472. Further, the body 402 includes a bottom receiving edge 476 extending along the bottom side 420 on the sole surface 460.

As illustrated in FIG. 11, the heel receiving edge 472 and toe receiving edge 480 are provided near a periphery of the body 402. The top receiving edge 484 is provided along the front side 416 of the body 402 near the topline 436 on the top side 418 and the heel receiving edge 472 and the bottom receiving edge 476 is disposed on the bottom side 420 of the body 402. The top receiving edge 484, heel receiving edge 472, toe receiving edge 480, and bottom receiving edge 476 are configured to receive the face insert 404 when coupled or joined together. In this way, the body 402 includes an interface comprising the top receiving edge 484, heel receiving edge 472, toe receiving edge 480, and bottom receiving edge 476 to which the face insert 404 is joined. In some embodiments, the face insert 404 contacts only the top receiving edge 484, the heel receiving edge 472, and the toe receiving edge 480 of the body 402, such that contact between the face insert 404 and the body 402 is limited to that interface and, thus, flexibility of the face insert 404 is improved. In some embodiments, the face insert 404 and the body 402 are coupled or joined by welding techniques, such as, e.g., by tack welding or laser welding, grinding, and polishing. In some embodiments, the face insert 404 is fastened to the body 402 by suitable fasteners, such as, e.g., by screws, rods, rivets, or the like. In some embodiments, the face insert 404 and the body 402 are integrally formed as a unitary component, such as, e.g., by casting, molding, additive manufacturing, or any other suitable method.

In the illustrated embodiment, the bottom receiving edge 476 on the sole surface 460 of the body 402 curves between the leading end 464 and the trailing end 468 within the heel region 428 and the toe region 424. Further, the bottom receiving edge 476 at least partially defines the sole cutout 452 between opposing portions of the heel receiving edge 472 and the toe receiving edge 480 on the bottom side 420 of the body 402. In the illustrated embodiment, the bottom receiving edge 476 extends along the sole member 454 on the bottom side 420 and toward the leading end 464 at the front side 416 of the body 402. Accordingly, the sole cutout 452 is at least partially defined by the sole member 454 within the medial region 426. In some embodiments, the sole cutout 452 extends continuously from the leading end 464 toward the trailing end 468 of the body 402. In some embodiments, the sole cutout 452 extends continuously along the medial region 426 between the heel region 428 and the toe region 424.

Staying with FIG. 11, the body 402 includes a rear flange 492 arranged on the rear side 422. The rear flange 492 extends from the heel region 428 to the toe region 424 of the body 402. Further, the rear flange 492 extends along the medial region 426 of the body 402 proximate to or along the topline 436 on the top side 418. In the illustrated embodiment, the rear flange 492 extends laterally along the topline 436, sloping upwardly from the heel region 428 to the toe region 424 before curving downwardly within the toe region 424 and extending vertically toward the sole surface 460 on the bottom side 420 of the body 402. The top inner surface 496 is at least partially formed on the rear flange 492 within the medial region 426 of the body 402. In the illustrated embodiment, the top inner surface 496 is arranged at or near the topline 436 and extends between the rear flange 492 and the top receiving edge 484. Further, a toe inner surface 500 is at least partially formed on the rear flange 492 within the toe region 424 of the body 402. In the illustrated embodiment, the toe inner surface 500 is arranged within the toe region 424 and extends between the rear flange 492 and the toe receiving edge 480.

Figure 13:
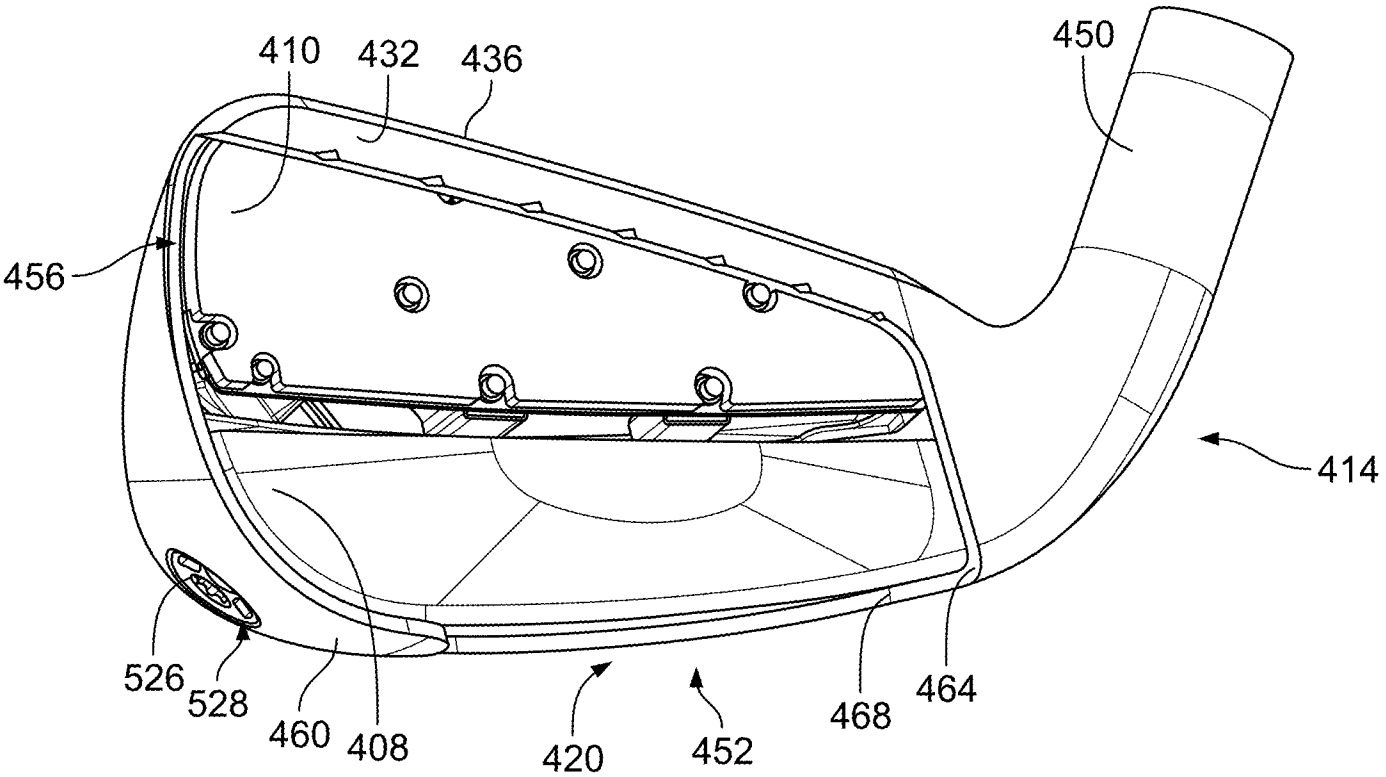
FIG. 13 is a front, bottom, and left isometric view of the club head of FIG. 9 with a face insert hidden from view.

The body cutout 456 is at least partially defined by the rear flange 492. The body cutout 456 is arranged on the rear side 422 of the body 402 and extends from the heel region 428 to the toe region 424 of the body 402. In the illustrated embodiment, the body cutout 456 extends continuously laterally along the medial region 426 of the body 402 and vertically from the topline 436 to the core bar 406. That is, the body cutout 456 is disposed vertically above the core bar 406, such that an upper segment 504 of the body 402 includes the topline 436 and the body cutout 456 and a lower segment 508 of the body 402 comprises the core bar 406 and the sole cutout 452. With reference to FIGS. 9 and 13, the medallion 410 is at least partially received within the body cutout 456 and is configured to be exposed through the body cutout 456 on the rear side 422 of the body 402. It is contemplated that the lower segment 508 of the body 102 comprises greater than 50% of a total mass of the body 402.

Figure 12:
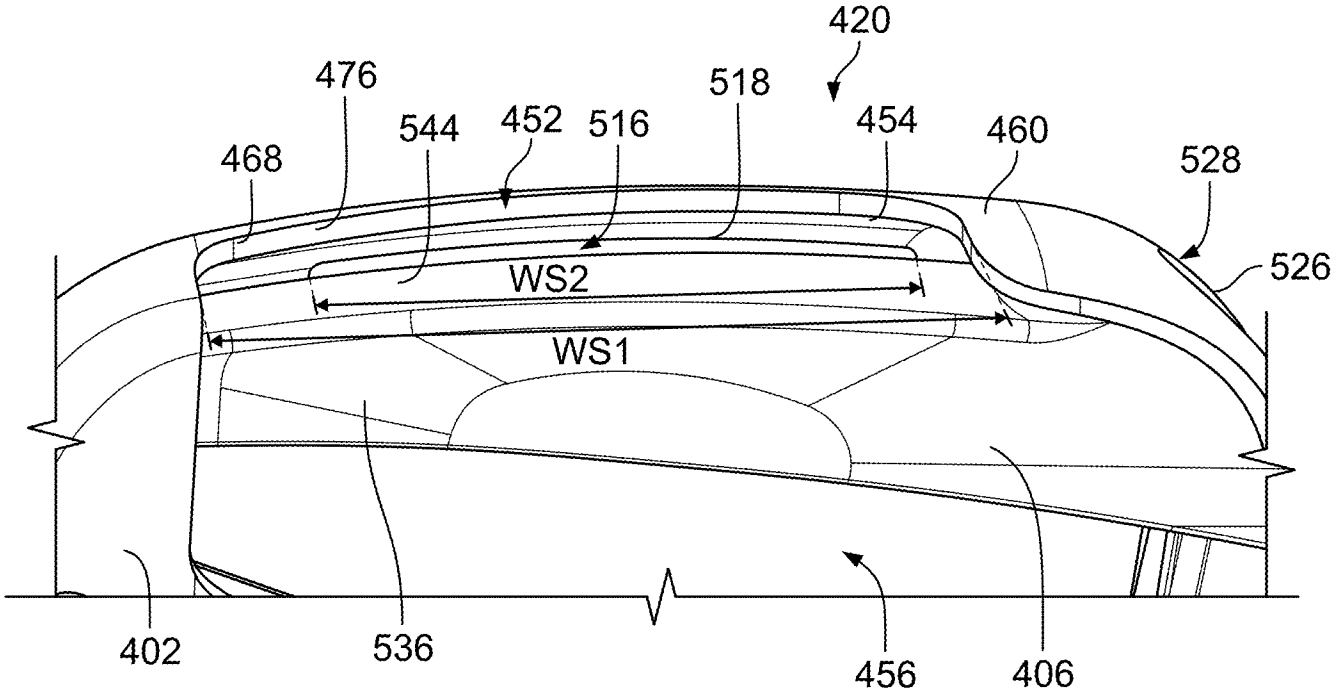
FIG. 12 is a rear, bottom, and left isometric view of a portion of the body of FIG. 11.
Figure 16:
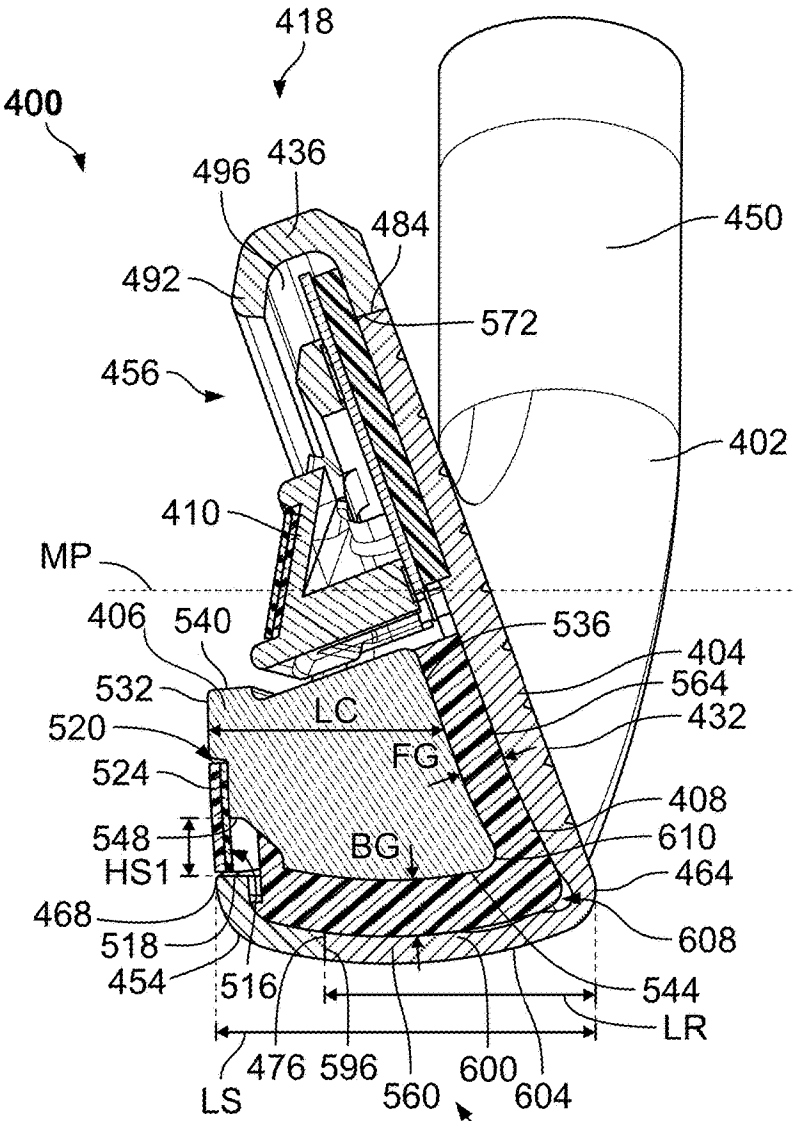
FIG. 16 is a cross-sectional view taken through the line 16-16 of FIG. 10.

In general, the rear side 422 of the body 402 includes a slot 516 formed along the trailing end 468 in an interior of the club head, as illustrated in FIG. 12. In the illustrated embodiment, the slot 516 is defined by a slot edge 518 that extends between the core bar 406 and the sole member 454. Additionally, the slot 516 extends continuously along the medial region 426 of the body 402. In some embodiments, the slot 516 extends from the heel region 428 to the toe region 424 of the body 402. Further, the slot 516 is in at least partial communication with the sole cutout 452 along the medial region 426 of the body 402, such that the slot 516 and the sole cutout 452 are fluidly connected. Referring specifically to FIG. 12, the sole cutout 452 defines a width WS1 between the toe receiving edge 480 and the heel receiving edge 472 on the bottom side 420 of the body 402. Further, the slot 516 defines a width WS2 along the trailing end 468 of the body 402. In the illustrated embodiment, the width WS2 of the slot 516 is less than the width WS1 of the sole cutout 452. In some embodiments, the width WS2 of the slot 516 is equal to or greater than the width WS1 of the sole cutout 452. The width WS1 of the sole cutout 452 may vary between the leading end 464 and the trailing end 468 of the body 402. In some embodiments, the width WS1 of the sole cutout 452 measured at the leading end 464 is greater than the width WS2 of the slot 516. Turning briefly to FIG. 16, the slot defines a height HS1 between the sole surface 460 and the rear core surface 532 of the core bar 406 on the trailing end 468 of the iron-type golf club head 100. In the illustrated embodiment, the height HS1 of the slot 516 within the heel region 428 is generally equal to the height HS1 of the slot 516 in the toe region 424. In some embodiments, the height HS1 of the slot 516 varies along from the heel region 428 to the toe region 424. Unlike the iron-type golf club head 100 of FIG. 8, the height HS1 of the slot 516 within the medial region 426 is defined independently of the arrangement of the sole return 560 when the face insert 404 is coupled to the body 402, as depicted in FIG. 16.

Figure 18:
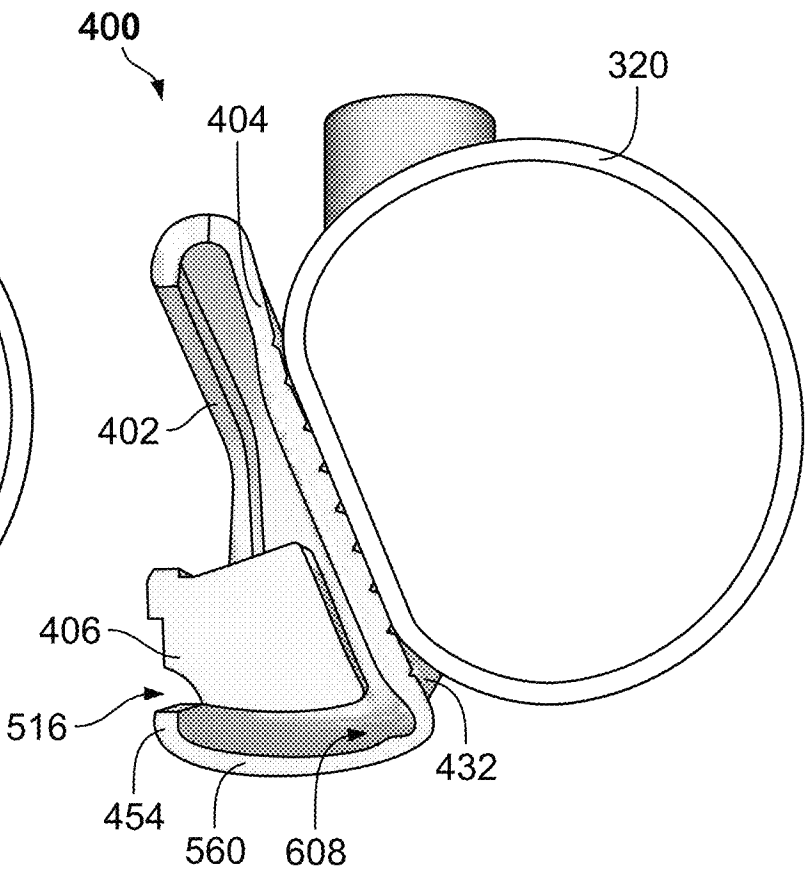
FIG. 18 is a schematic representation of a cross-sectional view of the club head of FIG. 9 during impact with a golf ball.

Referring to FIGS. 11, 12 and 16, the core bar 406 extends from the heel region 428 to the toe region 424. The core bar 406 extends continuously along the medial region 426. The core bar 406 includes a rear core surface 532 on the rear side of the body 402 and a front core surface 536 near a front side of the body 402. That is, the rear core surface 532 is disposed opposite the front core surface 536. In the illustrated embodiments, the front core surface 536 is curved and includes a particular contour that is configured to conform to the face insert 404 when coupled to the body 402. The core bar 406 further includes an upper core surface 540 that extends between the heel region 428 and the toe region 424, along the medial region 426, of the body 402. The upper core surface 540 curves between the heel region 428 and the toe region 424 of the body 402, such that the upper core surface 540 is curved concavely relative to the ground plane GP when the iron-type golf club head 100 is at address (see FIG. 10). Further, the core bar 406 includes a bottom core surface 544 that extends from the heel region 428 to the toe region 424, along the medial region 426, of the body 402. As illustrated in FIGS. 11 and 16, the front core surface 536 curves forwardly from the upper core surface 540 to the bottom core surface 544. The bottom core surface 544 curves between the heel region 428 and the toe region 424, such that the bottom core surface 544 is curved convexly relative to the ground plane GP. Further, the bottom core surface 544 is curved convexly in the front-to-rear direction, as illustrated in FIG. 18.

Referring to FIG. 16, the core bar 406 further includes an angled core surface 548 that extends along the medial region 426. The angled core surface 548 spans between the bottom core surface 544 and the rear core surface 532. A portion of the slot 516 is defined between the angled core surface 548 and the slot edge 518, e.g., where the rear core surface 532 meets the angled core surface 548. In particular, the slot edge 518 extends along the angled core surface 548 of the core bar 406, which is a lower edge of the core bar 406, and along an upper edge of the sole member 454, and the slot 516 spans therebetween. That is, the slot 516 is formed between the slot edge 518 along the core bar 406 and the slot edge 518 along the sole member 454 that is distanced from the core bar 406. Differently said, an upper edge of the slot 516 is formed by a lower edge of the core bar 406, i.e., where the slot edge 518 and the angled core surface 548 meet, at the trailing end 468 of the body 402, and a lower edge of the slot 516 is formed by an upper edge of the sole member 454, i.e., the slot edge 518 extending along the sole member 454, at the trailing end 468 of the body 402. Therefore, the slot 516 is formed entirely by the body 402 of the iron-type golf club 400, in contrast with the slot 216 that is formed between the body 102 and the sole return 260 of the face insert 104 of iron-type golf club head 100.

Referring to FIGS. 9 and 16, a notch 520 is formed on the rear side 422 of the body 402 at or near the trailing end 468 and a plate 524 is received by the notch 520. Further, the notch 520 is formed at least partially along the core bar 406 within the medial region 426 of the body 102. In the illustrated embodiment, notch 520 is irregularly shaped, although other configurations are contemplated. The notch 520 is in communication with the body cutout 456 on the rear side 422 of the body 402 and the slot 516 at the trailing end 468. The plate 524 is configured to fit within the notch 520 and, thus, the plate 524 is configured to have a shape that conforms to a shape of the notch 520. Further, plate 524 extends into the slot 516 to the slot edge 518 on the sole member 454, such that the plate 524 extends between the core bar 406 and the sole member 454. In some embodiments, the plate 524 is a medallion formed from a metal or metal alloy, e.g., aluminum, or a polymer, e.g., thermoplastic polyurethane (TPU), or a combination thereof. Further, the plate 524 may be secured to the body 402 and/or the face insert 404 by way of adhesion, e.g., tape, glue, cement, etc., or by fasteners, or welding, or fusion, or the like. Further, the club head 400 includes a weight insert 526 that is received within a weight receptacle 528 within the toe region 424 of the body 402. The weight insert 526 may be made of a material of greater density than the material of the body 102. For example, the weight insert 526 may be formed of a tungsten material. Further, the weight insert 526 may be removably received within the receptacle 528 by, e.g., threading. Accordingly, the weight insert 526 may be selectively removed from the receptacle 528.

Referring to FIGS. 13 and 16, the filler material 408 is disposed within the body 402. The filler material 408 may be a polymer material, e.g., rubber, thermoplastic resin, or the like. It is contemplated that the filler material 408 has a Shore A hardness of between about 20 Shore A and about 50 Shore A, or between about 25 Shore A and about 45 Shore A, or between about 30 Shore A and about 40 Shore A. In some embodiments, the filler material 408 has hardness of about 35 Shore A. The filler material 408 is configured to at least partially surround the core bar 406 of the body 402. In some embodiments, the filler material 408 is arranged to cover the front core surface 536, the bottom core surface 544, and the angled core surface 548. Accordingly, the filler material 408 is configured to cover at least three surfaces of the core bar 406, e.g., the bottom core surface 544, the front core surface 536, and the angled core surface 548. In some embodiments, the filler material 408 is arranged to cover a portion of the upper core surface 540. In addition, the filler material 408 may only partially cover the front core surface 536 and/or the angled core surface 548. In the illustrated embodiments, the filler material 408 is configured to conform to the shape of the front core surface 536 and the face insert 404. In some embodiments, the filler material 408 extends along the heel region 428, the medial region 426, and the toe region 424 of the body 402. The filler material 408 may be coextensive with the core bar 406 in both the heel region 428 and the toe region 424 of the body 402. The filler material 408 is configured to be disposed in the lower segment 508 of the body 402. In some embodiments, the filler material 408 is at least partially disposed in the upper segment of the body 402.

Figure 14:
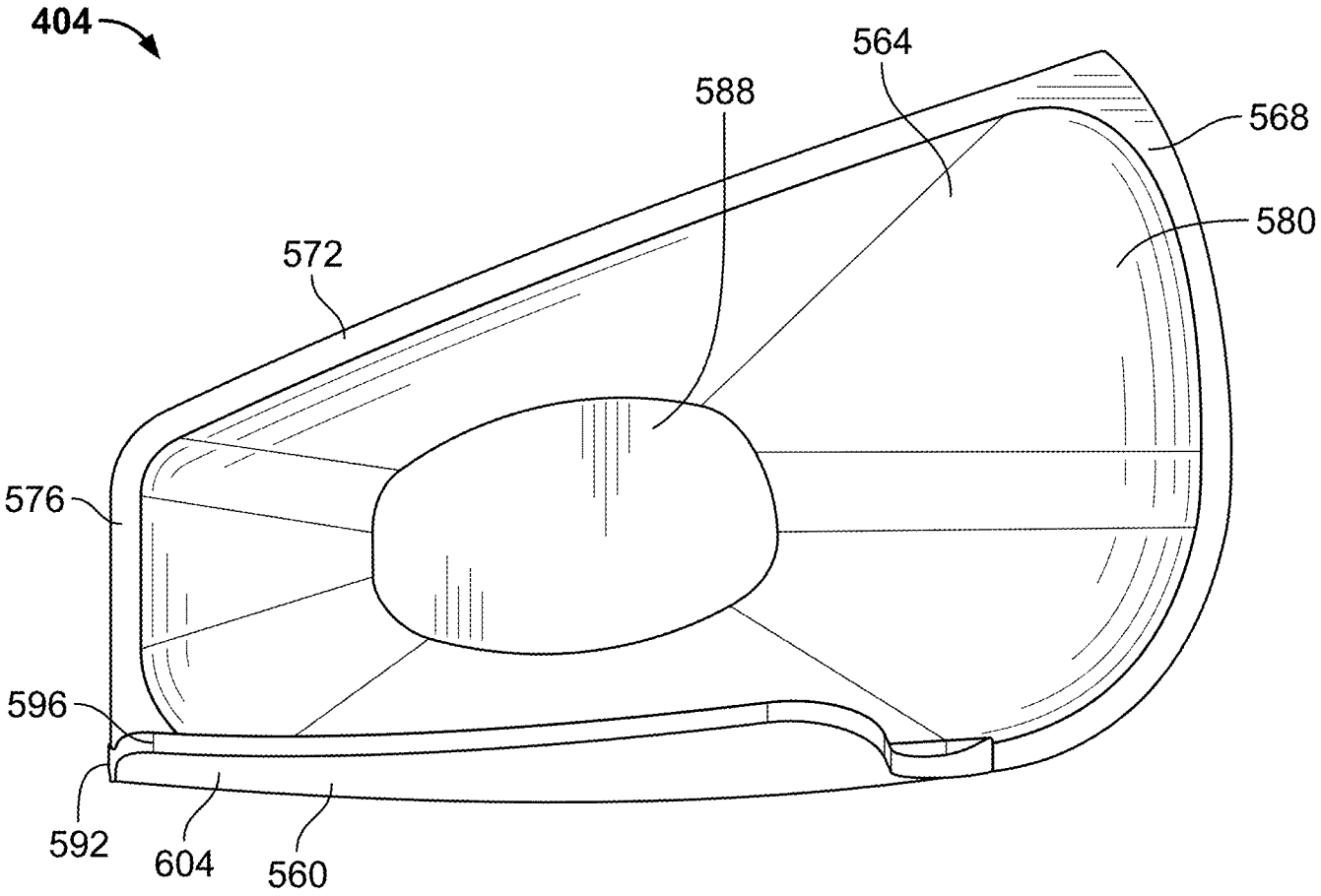
FIG. 14 is a rear elevational view of the face insert of the club head of FIG. 9.
Figure 15:
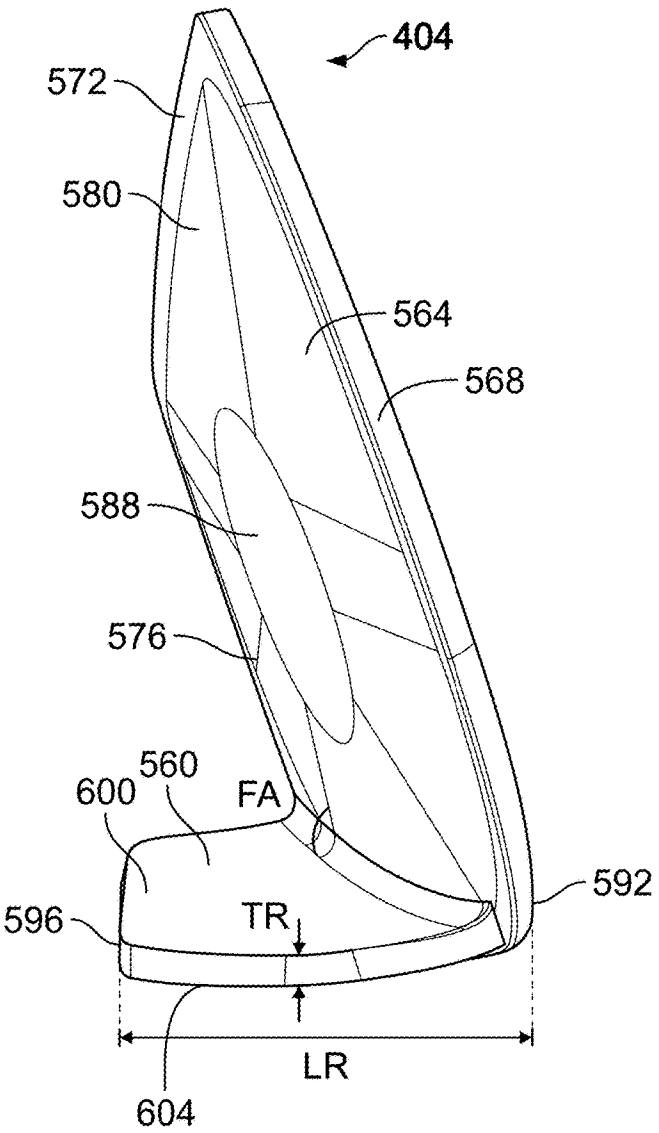
FIG. 15 is a rear and left isometric view of the face insert of FIG. 14.

Referring to FIGS. 14 and 15, the face insert 404 includes a sole return 560 and an inner surface 564 that comprises a toe peripheral edge 568, a top peripheral edge 572, and a heel peripheral edge 576. The toe peripheral edge 568 extends generally vertically in an arcuate path from the sole return 560 to the top peripheral edge 572. The heel peripheral edge 576 extends generally vertically from the sole return 560 to the top peripheral edge 572. Further, the top peripheral edge 572 is sloped upwardly as it extends from the heel peripheral edge 576 to the toe peripheral edge 568. The face insert 404 may be formed as a unitary component by various manufacturing methods, e.g., casting, forging, additive manufacturing, or the like. Accordingly, the face insert 404 may be composed of a metal or metal alloy, such as, e.g., Grade 17-4 Stainless Steel. It is contemplated that the face insert 404 may have a hardness, as measured using the Rockwell Scale C, of between about 25 HRC and about 55 HRC, or between about 30 HRC and about 50 HRC, or between about 36 HRC and about 42 HRC.

In the illustrated embodiment, the face insert 404 has a variable thickness, such that a distance between the front face 432 and the inner surface 564 varies along the face insert 404. Referring specifically to FIGS. 14 and 15, the face insert 404 includes a border zone 580 that has a first thickness and a central zone 588 that is disposed concentrically within the border zone 580 and that has a second thickness. Accordingly, the central zone 588 is surrounded by the border zone 580. Put another way, the central zone 588 and the border zone 580 are arranged concentrically on the inner surface 564 of the face insert 404. In some embodiments, the second thickness of the central zone 588 is greater than the first thickness of the border zone 580. Put another way, the inner surface 564 of the face insert 404 increases in thickness concentrically moving in an inward direction toward the central zone 588. In some embodiments, the first thickness of the border zone 580 is between about 1.0 mm and about 3.0 mm, or between about 1.4 mm and about 2.7 mm, or between about 1.8 mm and about 2.5 mm. In some embodiments the second thickness of the central zone 588 is between about 2.0 mm and about 3.0 mm, or between about 2.2 mm and about 2.8 mm, or between about 2.4 mm and about 2.6 mm. In some embodiments, the second thickness of the central zone 588 is about 2.5 mm. In some embodiments, the face insert 404 has a peripheral thickness or third thickness along the peripheral edges 568, 572, 576. In particular, the peripheral thickness may be between about 1.0 mm and about 2.6 mm, or between about 1.3 mm and about 2.3 mm, or between about 1.6 mm and about 2.0 mm. In some embodiments, the peripheral thickness is about 1.8 mm. In some embodiments, the peripheral thickness varies along the peripheral edges 568, 572, 576.

Referring to FIGS. 14 and 15, the sole return 560 extends outwardly away from the inner surface 564 at a lower end of the face insert 404. The sole return 560 extends from a leading edge 592 that is proximate the inner surface 564 to a trailing edge 596 that is distal or spaced apart from the inner surface 564. The sole return 560 has a return length LR that is defined between the leading edge 592 and the trailing edge 596. The return length LR may vary along the sole return 560 in the lateral direction between the heel peripheral edge 576 and the toe peripheral edge 568. Additionally, the sole return 560 has a return thickness TR between an inner return surface 600 and an outer return surface 604. The minimum return thickness TR may be disposed along the leading edge 592 to allow for increased flexibility of the face insert 404 in a hinge-like manner about the leading edge 592. The return thickness TR may vary along the sole return 560 in the lateral direction between the heel peripheral edge 576 and the toe peripheral edge 568. Further, the return thickness TR may vary along the sole return 560 in the front-to-rear direction between the leading edge 592 and the trailing edge 596. In some embodiments, the return thickness TR may be uniform along the sole return 560 between the trailing edge 596 and the leading edge 592. In some embodiments, the return thickness TR may be equal to a thickness of the sole surface 160 of the body 102 or a thickness of the sole member 454, or both. In some embodiments, the return thickness TR is less than the thickness of the sole surface 160 of the body 402, particularly when the sole return 560 is composed of a stronger, denser material than a material of the body 402. In some embodiments, the return thickness TR ranges between about 1.0 mm and about 2.0 mm, or between about 1.2 mm and about 1.8 mm, or between about 1.4 mm and about 1.6 mm. In some embodiments, the return thickness is about 1.5 mm. In the illustrated embodiment, the sole return 560 may be cup-shaped and conforms to the shape of the sole cutout 452 of the body 402, although other configurations are possible. A sole return angle FA is defined between the inner return surface 600 of the sole return 560 and the inner surface of the face insert 404. Preferably, the sole return angle FA corresponds with the loft angle of the iron-type golf club head 400.

Referring to FIGS. 9 and 16, the sole return 560 is configured to fit within the sole cutout when the face insert 404 is coupled to the body 402. In particular, the trailing edge 596 of the sole return 560 is configured to be disposed at or near the trailing end 468 of the body 402 on the rear side 422 of the iron-type golf club head 100. Further, the leading edge 592 of the sole return 560 is configured to be disposed at or near the leading end 464 of the body 402. As will be appreciated from FIGS. 9 and 16, the face insert 404 and the body 402 are coupled together along the interface formed between the toe receiving edge 480 and the toe peripheral edge 568, the heel receiving edge 472 and the heel peripheral edge 576, trailing edge 596 of the sole return 560 and the bottom receiving edge 476, and the top receiving edge 484 and the top peripheral edge 572. Accordingly, the sole return 560 spans the width WS1 of the sole cutout 452 between the heel receiving edge 472 and the toe receiving edge 480. In addition, the trailing edge 596 of the sole return 560 extends up to and abuts the sole member 454 on the trailing end of the body 402. Accordingly, the trailing edge 596 of the sole return 560 contacts the bottom receiving edge 476 on the sole member 454 at a point that is located closer to the trailing end 468 than to the leading end 464. With the trailing edge 596 of the sole return 560 spaced apart from the core bar 406, the face insert 404 is configured to be more flexible than conventional golf club heads. In some embodiments, the sole return 560 does not span the entirety of the sole cutout 452, such that the filler material 408 may extend into and fill spaces or gaps formed between the sole return 560 and body 402 within the sole cutout 452. In some embodiments, the sole return 560 includes a peripheral ledge (not shown) extending therealong near the outer return surface 604, such that a gap is formed between the sole return 560 and the body 402 near the inner return surface 600, thereby reducing the surface area of the sole return 560 in contact with the body 402, and the filler material 408 may occupy the gap formed between the sole return 560 and the body 402.

With reference to FIG. 16, an interior cavity 608 is formed between the face insert 404 the body 402. In particular, the interior cavity 608 is formed between the face insert 404 and the core bar 406. In some embodiments, the interior cavity 608 is formed by the inner surface 564 of the face insert 404, the inner return surface 600 of the sole return 560, the bottom core surface 544, the front core surface 536, and the toe inner surface 500 of the body 402. The interior cavity 608 extends along the heel region 428, the medial region 426, and the toe region 424. Further, the interior cavity 608 is a volume in which the filler material 408 is disposed within the iron-type golf club head 400. In some embodiments, the interior cavity 608 is at least partially filled with the filler material 408. For example, the filler material 408 may be poured or injected into the interior cavity 608 and allowed to harden or set. In some embodiments, the interior cavity 608 and any voids or gaps thereof are entirely filled filler material 408. Accordingly, the inner return surface 600 of the sole return 560 is spaced apart from the bottom core surface 544 of the core bar 406 along the length LR of the sole return 560. Likewise, the inner surface 564 of the face insert 404 is spaced apart from the front core surface 536 of the core bar 406. It will be appreciated that the slot 516 is elevated or raised relative to the sole return 560 of the face insert 404. That is, the trailing edge 596 of the sole return 560 is spaced apart from the slot 516. It is contemplated that ribs or posts (not shown) may be disposed within the interior cavity 608. For example, ribs or projections (not shown) may extend from and along the inner return surface 600 or the inner surface 564 of the face insert 404, the core bar 406, or another portion of the body 402.

Referring specifically to FIG. 16, a front gap distance FG of a front gap of the interior cavity 608 may be defined between the front core surface 536 of the core bar 406 and the inner surface 564 of the face insert 404. A bottom gap distance BG of a bottom gap of the interior cavity 608 may be defined between the bottom core surface 544 of the core bar 406 and the inner return surface 600 of the sole return 560. Further, the bottom gap distance BG is also defined between the bottom core surface 544 of the core bar 406 and the inner surface of the sole member 454. In the illustrated embodiment, the front gap distance FG is generally uniform between the core bar 406 and the face insert 404 due, at least partially, to the conforming shapes of the front core surface 536 and the inner surface 564 of the face insert 404. In some embodiments, the front gap distance FG varies along the core bar 406 and/or the face insert 404, such as, e.g., laterally between the heel region 428 and the toe region 424, or vertically between the upper core surface 540 and the bottom core surface 544, or a combination thereof. Further, the bottom gap distance BG decreases in the front-rear direction from the front core surface 536 and the slot 516. Accordingly, the bottom gap distance BG may be greater than the front gap distance FG at a point near the front core surface 536 and, also, the bottom gap distance BG may be equal to or less than the front gap distance FG at a point near the slot 516. It is contemplated that the front gap distance FG may vary between about 40% and about 100% of the bottom gap distance BG. Further, the bottom gap distance BG near the slot 516 may be less than the height HS1 of the slot 516 (see FIG. 4) within the medial region 426, the toe region 424, or the heel region 428 of the iron-type golf club head 400. In some embodiments, the bottom gap distance BG varies along the medial region 426 between the heel region 428 and the toe region 424 of the iron-type golf club head 400. In some embodiments, the bottom gap distance BG is uniform in the front-rear direction, or the heel-toe direction, or both.

A head sole length LS is defined between the front face 432 at the leading end 464 of the head 100 and the rear core surface 532 at the trailing end 468 of the iron-type golf club head 400. Accordingly, the head sole length LS is approximately equal to a distance between the slot 516 at the trailing end 468 and the front face 432 at the leading end 464. In some embodiments, the head sole length LS is greater than the return length LR of the sole return 560. In some embodiments, the return length LR comprises between about 60% and about 90% of the head sole length LS, or between about 65% and about 85% of the head sole length LS, or between about 70% and about 80% of the head length LS. As described above with respect to the iron-type golf club head 100, it has been found that the flexibility of the face insert 4040 increases in proportion to the thickness and extension of the sole return 560 of the face insert 4040 from the leading end 464 to or near the trailing end 468, such that decreasing the return thickness TR and increasing the return length LR increase the flexibility of the face insert 504. In some embodiments, providing the return thickness TR of the sole return 560 to be equal to or less than the thinnest portion, e.g., the first thickness of the border zone 580, and providing the return length LR to be greater than 50% of the head sole length LS increases the flexibility of the face insert 404 at impact. This flexibility is further improved or enhanced by the thin, peripheral interface along which the face insert 404 is joined to the body 402. In this way, the face insert 404 is coupled to the relatively thin portions of the body 402, e.g., the receiving edges 472, 476, 480, 484, and decoupled or distanced from the thickest portion, e.g., the core bar 406, of the body 402.

In a similar fashion to the core bar 106 of the iron-type golf club 100, the core bar 406 is sized and shaped to contain a core mass CM that comprises greater than 50% of a body mass BM of the body 402. In this way, the portions of the body 402 that surround the core bar 406 can be made flexible and thin, while the core bar 406 is stiffened and thick. At the same time, the core bar 406 and the body 402 are configured to concentrate the body mass BM and the core mass CM in the heel region 428 and the toe region 424, which increases a moment of inertia MOI of the iron-type golf club head 400. Additionally, the core bar 406 is located within the body 402 to distribute and position the core mass CM downwardly toward the sole 440 on the bottom side 420 and rearwardly toward the rear side 422 of the iron-type golf club head 400, which moves a center of gravity CG of the iron-type golf club head 400 downward and rearward. Accordingly, the core bar 406 is located entirely within the lower segment 508 of the body 402. Further, the core bar 406 is located below a mid-plane MP defined between the topline 436 and the sole 440 of the iron-type golf club head 400, as illustrated in FIG. 16. In general, the mid-plane MP is disposed approximately centrally between the topline 436 and the sole 440 within the medial region 424. Further, the sole return 560 and the core bar 406 are configured to have corresponding properties, e.g., size, shape, mass, material. Accordingly, the return thickness TR is configured to be sized to correspond with the dimensions of the core bar 406 to maintain the bottom gap distance BG, which may allow the core bar 406 to be increased in size below the mid-plane MP to distribute and position the core mass CM downwardly toward the sole 440 and rearwardly toward the rear side 422.

Further, a core bar length LC is defined between the rear core surface 532 and the front core surface 536. The core bar length LC varies along the core bar 406 between the upper core surface 540 and the bottom core surface 544. In the illustrated embodiment, the core bar length LC is less than the head sole length LS. In some embodiments, the core bar length LC comprises between about 50% and about 90% of the head sole length LS, or between about 60% and about 80% of the head sole length LS, or between about 65% and about 75% of the head sole length LS. In some embodiments, the core bar length LC is approximately equal to the return length LR. In some embodiments, the core bar length LC is less than the return length LR. The core bar 406 further defines a forwardmost point 610 that is disposed closest to the leading end 464 on the front side 416 of the iron-type golf club head 400 relative to the remainder of the core bar 406. As such, the forwardmost point 610 may be located between about 5% and about 50% of the length LS from the leading end 464, or between about 10% and about 40%, or between about 15% and about 30%. In some embodiments, the forwardmost point 610 of the core bar 106 is located at about 25% of the length LS from the leading end 464.

It is contemplated that the filler material 408 disposed inside the iron-type golf club head 400 between the core bar 406 and the face insert 404 provides several advantages. For example, when the iron-type golf club head 400 strikes the golf ball 320 (see FIG. 18) the face insert 404 elastically deforms in a manner that causes displacement and compression of the filler material 408. Accordingly, interaction between the filler material 408 and the face insert 404 during impact results in, e.g., improved sound attenuation and increased kinetic energy return. Conventional, hollow golf club heads with empty internal volumes produce a loud, reverberating sound, often at high pitches or frequencies, which golfers may find unsuitable, especially when such sound is noticed by other players or detected during televised play. By contrast, the iron-type golf club head 400 of the present disclosure produces an attenuated or muffled sound at a lower pitch or frequency during impact with a golf ball, at least partially due to filler material 408 occupying the interior cavity 608 to absorb the sound waves and, thus, preventing a lack of empty volume within the interior cavity 608 in which sound may reverberate. Further, the face insert 404 is configured to elastically deform or flex during impact with a golf ball, while the filler material 408 absorbs and returns kinetic energy caused by compression between the deformed face insert 404 and the core bar 406 within the interior cavity 608. That is, the filler material 408 prevents direct contact between the face insert 404 and the core bar 406 due to its position therebetween, and the filler material 408 improves energy return with spring-like performance due the material properties, e.g., the reduced Shore A hardness. In this way, kinetic energy is returned to the face insert 404 for transfer to the golf ball, rather than merely being absorbed within the interior cavity 608 or stifled by the relatively stiff, inflexible body 402, and particularly the inflexible core bar 406, of the iron-type golf club head 400.

Additionally, vibrations are felt by the golfer through a shaft (not shown) that is connected to the body 402 by the hosel 450. Such vibrations, which are often referred to as the "feel" of the club, may be amplified in intensity and duration by conventional, hollow golf club heads. However, the filler material 408 of the iron-type golf club head 400 of the present disclosure absorbs vibrations during impact, resulting in a softened feel that is preferred by golfers. Further, the feel of the iron-type golf club head 400 may be customized to suit the desire of the golfer by varying the filler material 408 material properties, amount, arrangement, and displacement within the iron-type golf club head 400. In a similar manner, the slot 516 and plate 524 disposed therein affords for sound attenuation, kinetic energy return, and improved feel of the iron-type golf club head 400 by allowing the sole return 560 of the face insert 404 to be displaced while acting as a cushion between the sole return and the core bar 406 of the body 102. Further, because of the position and material properties of the filler material 408, when the face insert 404 elastically deforms during impact with the golf ball 320, the face insert 404 does not directly contact the core bar 406 and is dampened to reduce or prevent continued flexing and vibration after impact. More specifically, the inner surface 564 of the face insert 404 does not directly contact the front core surface 536 of the core bar 406, in part due to the filler material 408 disposed therein and also in part due to the front gap distance FG provided between the face insert 404 and the core bar 406. Accordingly, the core bar 406 is configured to be suspended within the body 402 of the club head 400 and distanced from direct contact with the face insert 404 in both impact and rest states. In this way, the face insert 404 is prevented from direct contact with the most inflexible portion of the body 402, e.g., the core bar 406.

Figure 17:
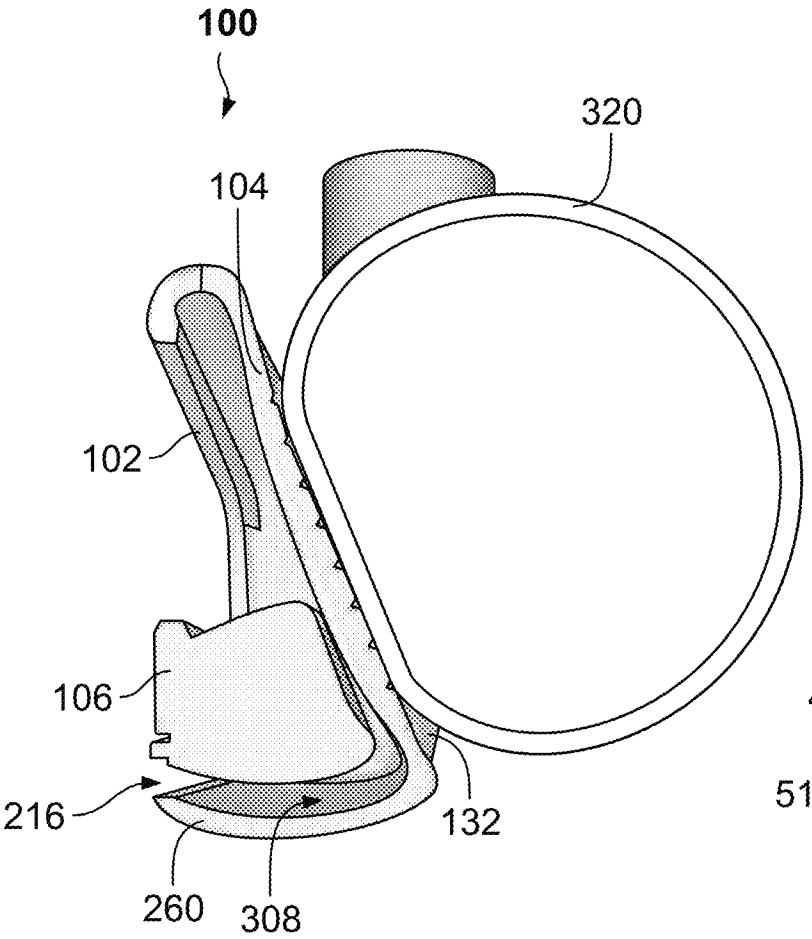
FIG. 17 is a schematic representation of a cross-sectional view of the club head of FIG. 1 during impact with a golf ball.

FIG. 17 illustrates a schematic representation of the body 102 and the face insert 104 of the iron-type golf club head 100 (with the filler material removed) during impact with the golf ball 320, in which the front face 132 strikes the golf ball 320. As a result of impact, both the golf ball 320 and the face insert 104 are depicted as being elastically deformed. The face insert 104 deforms by bending or flexing rearwardly into the interior cavity 308. However, the face insert 104 does not flex far enough into the interior cavity 308 to contact the core bar 106. Further, the sole return 260 is spaced apart from the core bar 106 and, thus, the sole return 260 also deforms or flexes into the interior cavity 308 and the slot 216 during impact. However, the sole return 260 does not flex far enough into the slot 216 and the interior cavity 308 to contact the core bar 106.

Similarly, FIG. 18 illustrates a schematic representation of the body 402 and the face insert 404 of the iron-type golf club head 400 (with the filler material removed) during impact with the golf ball 320, in which the front face 432 strikes the golf ball 320. As a result of impact, both the golf ball 320 and the face insert 404 are depicted as being elastically deformed. The face insert 404 deforms by bending or flexing rearwardly into the interior cavity 608. However, the face insert 404 does not flex far enough into the interior cavity 608 to contact the core bar 406. Further, the sole return 560 and sole member 454 is spaced apart from the core bar 406 and, thus, the sole return 560 and sole member 454 also deform or flex into the interior cavity 608 and the slot 516 during impact. However, the sole return 560 and the sole member 454 do not flex far enough into the slot 516 and the interior cavity 608 to contact the core bar 406.

The iron-type golf club heads 100 and 400 may be manufactured according to a variety of methods. For example, the iron-type golf club head 100 may be manufactured by a method comprising the steps of forming the body 102 and the face insert 104 separately from one another, the body 102 including the core bar 106 and the slot 216. Further, the iron-type golf club head 100 can be manufactured by joining, e.g., welding, the face insert 104 to the body 102 to form the interior cavity 308, which includes a first gap between the inner surface 264 of the face insert 104 and the core bar 106, e.g., the front gap distance FG, and a second gap between the sole return 260 and the core bar 106, e.g., the bottom gap distance BG. Put another way, the face insert 104 may be welded to the body 102 and distanced from the core bar 106. Additionally, the iron-type golf club head 100 can be manufactured by filling the slot 216 with the slot filler material 312 and pouring the cavity filler material 108 into the interior cavity 308 to fill the gaps. In addition, the medallion 110 may be attached to the body 102 within the body cutout 156 to cover the interior cavity 308 and the filler material 108 therein.

It will be appreciated that the iron-type golf club head 400 may be manufactured by a similar method as used for the iron-type golf club head 100. For example, the iron-type golf club head 400 may be manufactured by a method comprising the steps of forming the body 402 and the face insert 404 separately from one another, the body 402 including the core bar 406 and the slot 516. Further, the iron-type golf club head 400 can be manufactured by joining, e.g., welding, the face insert 404 to the body 402 to form the interior cavity 608, which includes a first gap between the inner surface 564 of the face insert 404 and the core bar 406, e.g., the front gap distance FG, and a second gap between the sole return 560 and the core bar 406, e.g., the bottom gap distance BG. Put another way, the face insert 404 may be welded to the body 402 and distanced from the core bar 406. Additionally, the iron-type golf club head 400 can be manufactured by inserting the plate 524 within the slot 516 and pouring the filler material 408 into the interior cavity 608 to fill the gaps. In addition, the medallion 410 may be attached to the body 402 within the body cutout 456 to cover the interior cavity 608 and the filler material 408 therein.

Any of the embodiments described herein may be modified to include any of the structures or methodologies disclosed in connection with different embodiments. Further, the present disclosure is not limited to golf clubs of the type specifically shown. Still further, aspects of the golf club heads of any of the embodiments disclosed herein may be modified to work with any type of golf club.

As noted previously, it will be appreciated by those skilled in the art that while the disclosure has been described above in connection with particular embodiments and examples, the disclosure is not necessarily so limited, and that numerous other embodiments, examples, uses, modifications and departures from the embodiments, examples and uses are intended to be encompassed by the claims attached hereto. The entire disclosure of each patent and publication cited herein is incorporated by reference, as if each such patent or publication were individually incorporated by reference herein. Various features and advantages of the disclosure are set forth in the following claims.

INDUSTRIAL APPLICABILITY

Numerous modifications to the present disclosure will be apparent to those skilled in the art in view of the foregoing description. Accordingly, this description is to be construed as illustrative only and is presented for the purpose of enabling those skilled in the art to make and use the same. The exclusive rights to all modifications which come within the scope of the appended claims are reserved.

We claim:

1. A golf club head, comprising:

a body including a sole portion, a toe region, a heel region, and a medial region extending between the toe region and the heel region, the body at least partially defining an elongate slot that extends from the toe region to the heel region in a toe-heel direction;

a face insert coupled to a front side of the body;

a core bar that is unitary with the body at the toe region and the heel region such that opposing ends of the core bar are attached to the toe region and the heel region, respectively, and the core bar is suspended across the sole portion of the body in the medial region such that an interface between the core bar and the body is limited to opposing ends of the core bar in the heel region and the toe region;

an interior cavity defined between the face insert and the core bar; and a filler material that is disposed within the interior cavity and is in direct contact with at least three surfaces of the core bar, wherein the core bar defines:

a front core surface facing the face insert; and a rear core surface opposite the front core surface, wherein the sole portion extends between the front side and a rear side of the body.

2. The golf club head of claim 1, wherein the filler material is a polymer.

3. The golf club head of claim 1, wherein the slot is filled with a slot filler material.

4. The golf club head of claim 1, wherein a slot lower edge of the slot is defined by a portion of the face insert that is spaced apart from the core bar.

5. The golf club head of claim 1, wherein a slot lower edge of the slot is defined by a portion of the body that is spaced apart from the core bar.

6. A golf club head, comprising:

a body including a sole portion, a toe region, and a heel region, the body defining a front side and a rear side opposite the front side, the sole portion extending between the front side and the rear side;

a core bar that is unitary with the body and extends between the toe region and the heel region such that opposing ends of the core bar are attached to the toe region and the heel region, respectively, and the core bar is suspended across the sole portion of the body such that an interface between the core bar and the body is limited to opposing ends of the core bar in the heel region and the toe region; and a face insert coupled to the front side of the body, the face insert including a sole return extending from a lower end of a face surface of the face insert rearward to a trailing edge of the face insert that is disposed at an interface between the sole portion and the rear side of the body, wherein the core bar defines:

a front core surface facing the face insert; and a rear core surface opposite the front core surface and defining the rear side of the body, wherein an interior cavity is formed between the sole return and the core bar; and wherein a filler material is arranged within the interior cavity and the filler material is in direct contact with at least three surfaces of the core bar.

7. The golf club head of claim 6, wherein the interior cavity has a first gap distance and a second gap distance, the first gap distance being different from the second gap distance.

8. The golf club head of claim 6, wherein the trailing edge of the sole return is disposed adjacent to a slot along the rear side of the body.

9. The golf club head of claim 8, wherein the sole return has a thickness that varies between the trailing edge and a leading edge.

10. The golf club head of claim 9, wherein the sole return and the face insert comprise a unitary component.

11. The golf club head of claim 6, wherein the filler material is a polymer.

12. The golf club head of claim 11, wherein the face insert is coupled to the body along a receiving edge that at least partially surrounds the core bar.

13. A method of manufacturing a golf club head, the method comprising:

forming a body and a face insert separately from one another, the body including a front side, a rear side opposite the front side, a heel region, a toe region, and a sole portion;

forming a core bar as a unitary component with the heel region and the toe region of the body such that opposing ends of the core bar are attached to the toe region and the heel region, respectively, and the core bar is suspended across the sole portion of the body such that an interface between the core bar and the body is limited to opposing ends of the core bar in the heel region and the toe region, wherein a slot is disposed within the rear side and offset with respect to an interface between the sole portion and the rear side, wherein the slot is defined at least partially by a lower edge of the core bar;

joining the face insert to the front side of the body to form an interior cavity, such that the face insert is distanced from the core bar;

filling the slot with a first material; and filling the interior cavity with a second material, wherein the core bar defines:

a front core surface facing the face insert; and a rear core surface opposite the front core surface and defining the rear side of the body.

14. The method of claim 13 further comprising forming a sole cutout in the sole portion that extends between a leading end of the body and a trailing end of the body.

15. The method of claim 14, wherein joining the face insert to the body includes receiving a sole return of the face insert within the sole cutout of the sole portion.

16. The method of claim 13 further comprising forming a notch on the rear side of the body and within a medial region of the body.

17. The method of claim 16 further comprising receiving a portion of a plate within the notch to secure the plate to the body.

* * * * *